United States Patent [19]

Bolejack et al.

[11] Patent Number: 5,014,495

[45] Date of Patent: May 14, 1991

[54] METHOD AND APPARATUS FOR BAGGING PRODUCT UNITS

[76] Inventors: Kevin J. Bolejack, 1514 Colusa Pl.; Frederick Forgnone, 270 San Benancho Canyon Rd.; Christopher McCoy, 710 Los Coches, all of Salinas, Calif. 93906

[21] Appl. No.: 473,919

[22] Filed: Jan. 31, 1990

[51] Int. Cl.[5] ..... B65B 41/14; B65B 11/50; B65B 31/02; B65B 67/12

[52] U.S. Cl. ..... 53/433; 53/434; 53/469; 53/157; 53/175; 53/389.1

[58] Field of Search ..... 53/433, 434, 449, 459, 53/511, 512, 389, 390, 391, 392, 461, 175, 157, 419, 408, 469, 570, 410, 139.3; 414/281, 286, 589

[56] References Cited

U.S. PATENT DOCUMENTS

| | | | |
|---|---|---|---|
| 3,001,352 | 9/1961 | Harrison | 53/389 |
| 3,343,334 | 9/1967 | Bode et al. | 53/389 X |
| 3,429,095 | 2/1969 | Huson | 53/434 X |
| 3,473,290 | 10/1969 | Culpepper | 53/392 X |
| 3,577,700 | 5/1971 | Bippus et al. | 53/389 X |
| 3,584,428 | 6/1971 | Falk | 53/391 X |
| 3,648,433 | 3/1972 | Owen | 53/390 X |
| 3,664,089 | 5/1972 | Keck | 53/389 X |
| 3,693,318 | 9/1972 | Balzer et al. | 53/389 X |
| 3,710,533 | 1/1973 | Burns | 53/389 X |
| 4,055,931 | 11/1977 | Myers | 53/408 |
| 4,546,598 | 10/1985 | Karpisek | 53/390 X |
| 4,821,489 | 4/1989 | Macleod et al. | 53/419 |

*Primary Examiner*—Horace M. Culver

[57] ABSTRACT

A method and apparatus are disclosed for sealing pallets of fresh produce inside plastic bags and furnishing the interiors of the sealed bags with a modified gaseous atmosphere.

33 Claims, 22 Drawing Sheets

59
70
54
52
64
42
71
50
40
64
71
64
70
59

70
52
50
64
64
71
71
16
42
40
70

FIG. 8
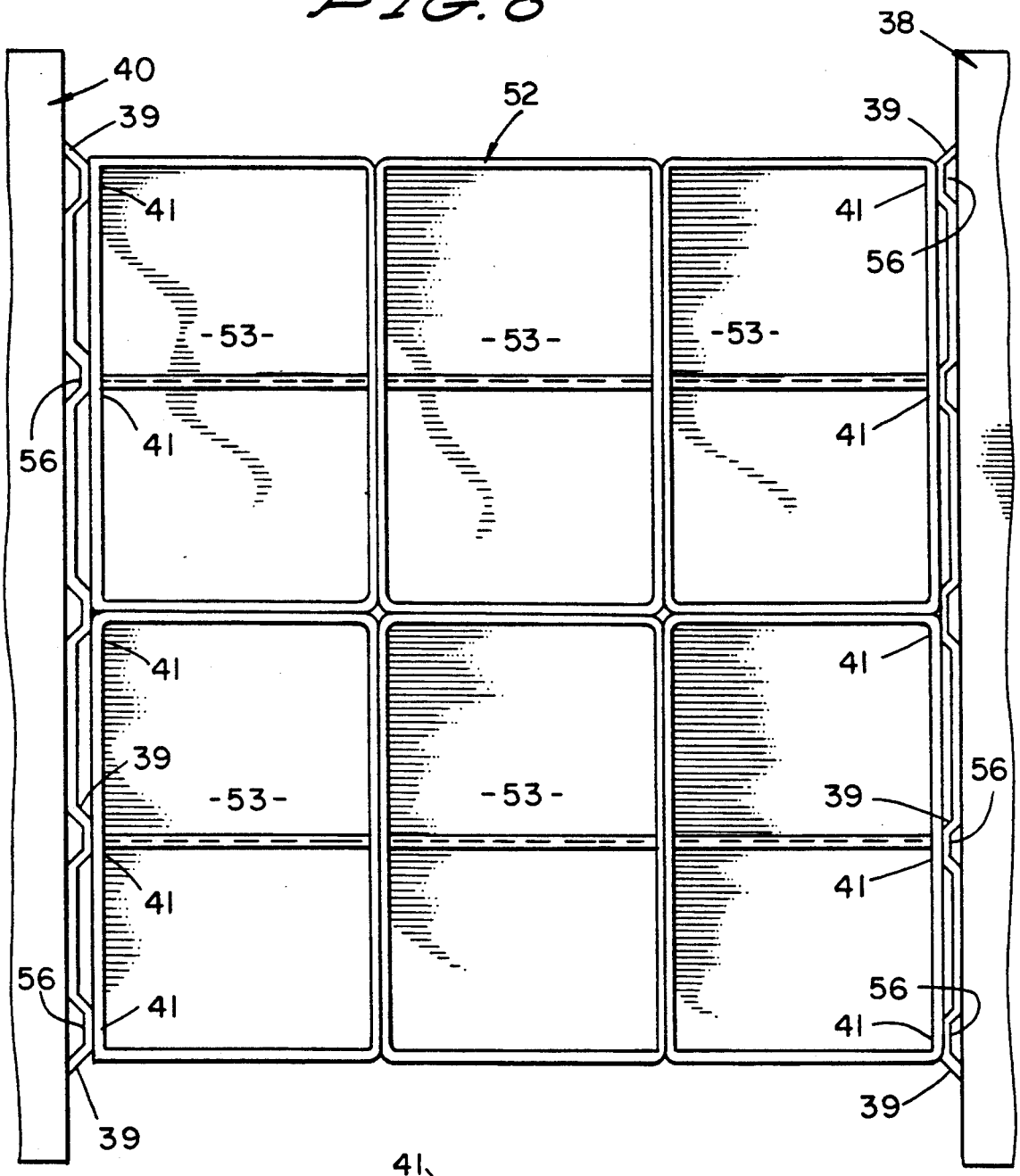
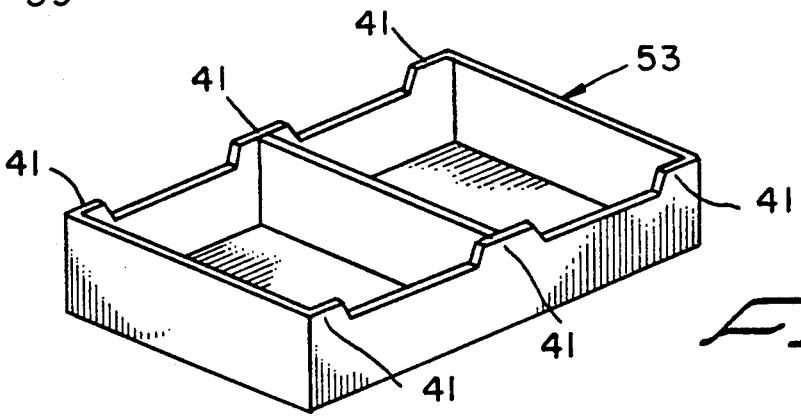
FIG. 9

FIG. 12
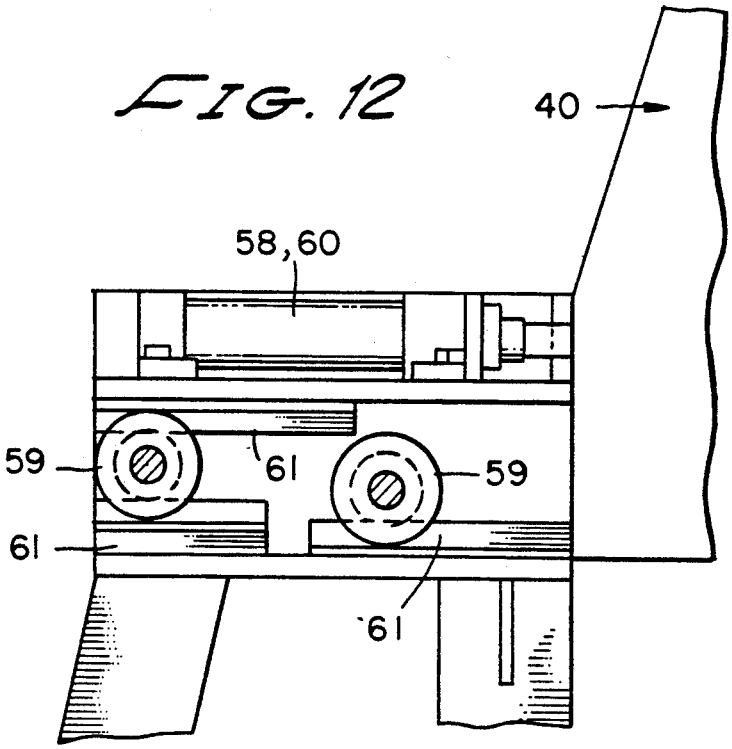
FIG. 13
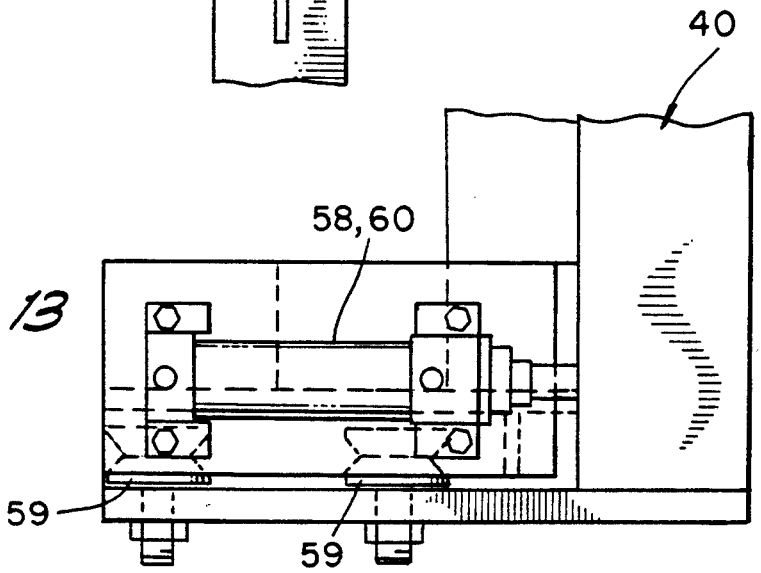
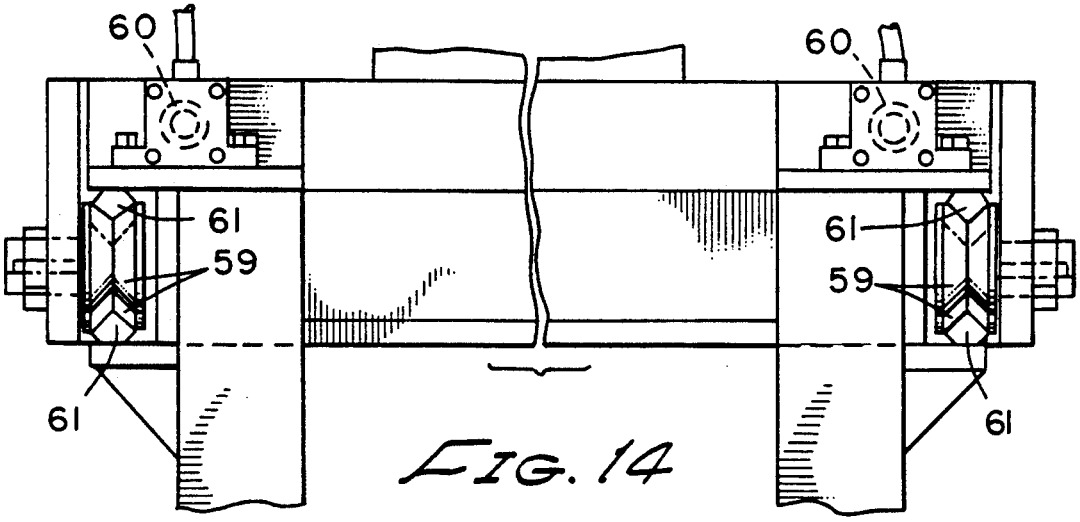
FIG. 14

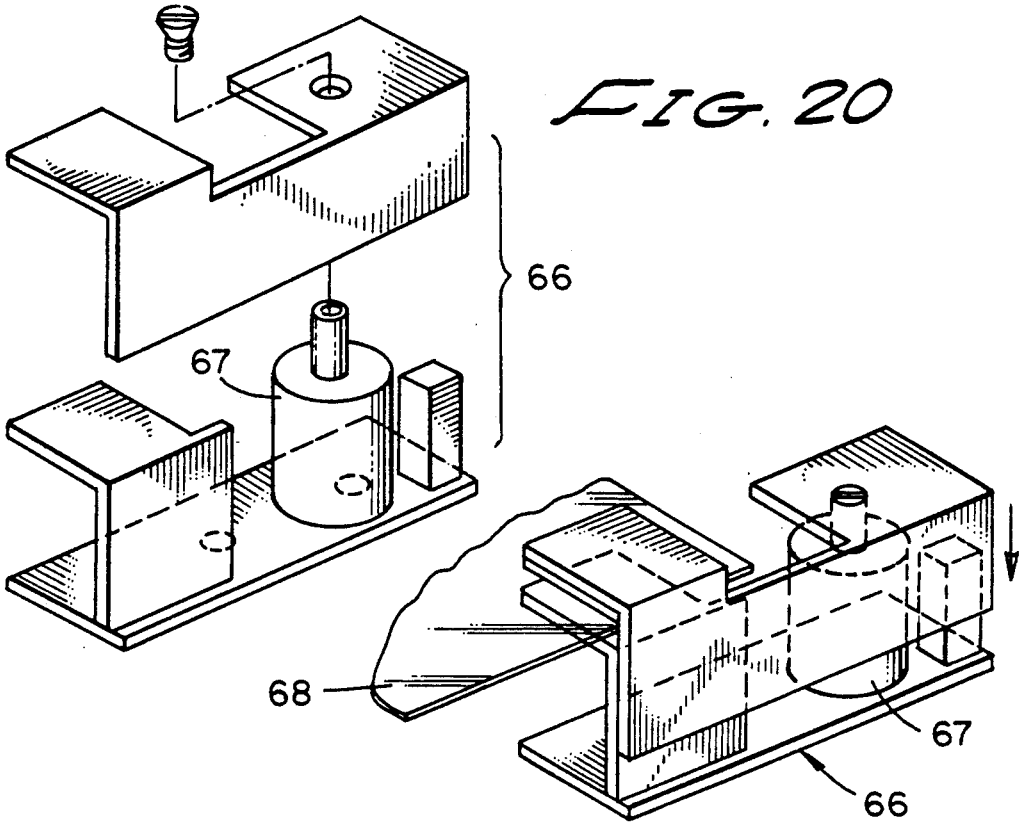
FIG. 20
FIG. 21
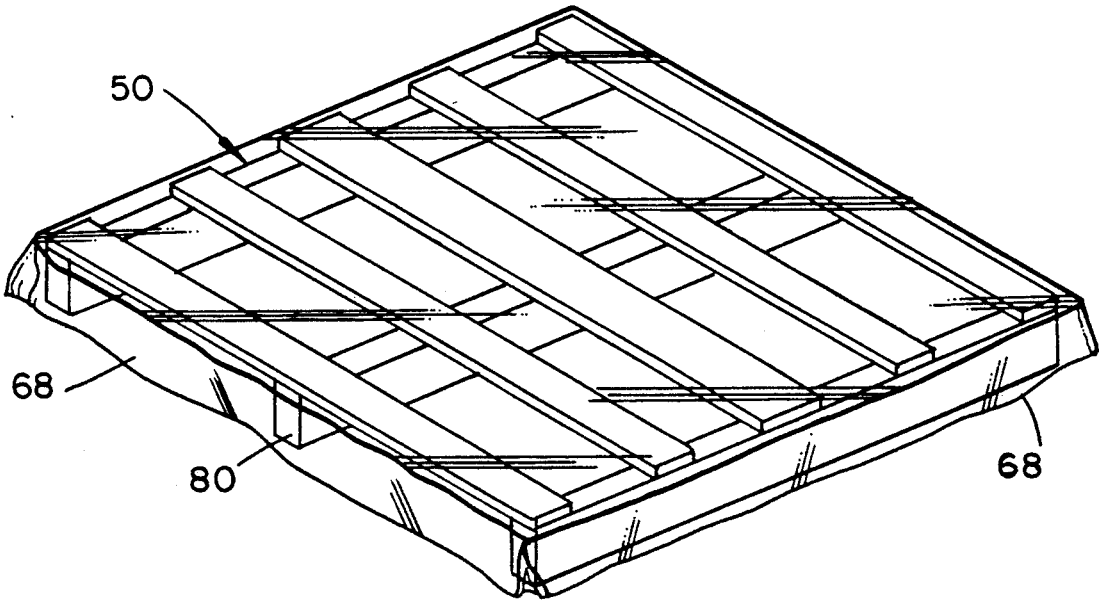
FIG. 22

METHOD AND APPARATUS FOR BAGGING PRODUCT UNITS

BACKGROUND OF THE INVENTION

1. Field of the Invention

The invention relates to the field of bagging product units on a production line, and in particular to a method and apparatus for bagging agricultural produce pallets in preparation for modifying the atmosphere surrounding the produce inside the bag with a gas or gas mixture to retard ripening and spoilage, or to otherwise promote freshness and extend the shelf life of such produce.

2. Description of the Related Art

The ripening of agricultural produce such as tomatoes or peaches is affected by the atmosphere surrounding the produce. Many foodstuffs, such as fresh produce (e.g., strawberries, lettuce, tomatoes, cauliflower), can have their fresh condition maintained for an extended period of time by controlling the gaseous atmosphere inside the package in which they are contained. Losses during shipment and storage can be substantially decreased in this manner so that a greater percentage of fresh produce can be delivered to the consumer in acceptable condition.

Many kinds of fresh produce, a primary one being strawberries, are shipped in a quantity of boxes on a pallet base, with the entire load being enclosed by a plastic bag that is sealed to the base. U.S. Pat. No. 4,055,931, which is hereby incorporated herein by reference, discloses the providing of a special atmosphere into the containing space formed by the plastic bag by first inserting a sharp-ended nozzle through the plastic sheeting, evacuating the air inside the bag, and introducing gases into the interior. U.S. Pat. application Ser. No. 07/311,225, filed Feb. 15, 1989, entitled "Method and Apparatus for Bagging Product Units," by Kevin J. Bolejack and Frederick Forgnone is hereby also incorporated herein by reference.

That application discloses a method and apparatus for enclosing pallets of fresh produce in sealed bags and furnishing the interiors of the sealed bags with a modified gaseous atmosphere for preserving such produce. Conventional pallets loaded with fresh produce are transported from cooling tunnels to an input conveyor. The input conveyor moves the pallets automatically one at a time to an in-line squeeze station. When a pallet is positioned on the squeeze station the conveyor stops automatically. The produce load of a pallet positioned at the squeeze station is squeezed between opposed vertical walls to suspend it above the pallet base as a downwardly movable floorplate descends to allow the pallet base to be removed and replaced with a pallet having a plastic sheet lining secured between the pallet board runners and pallet deck boards. Then the floorplate is raised to its former level to bear the weight of the loaded pallet as the produce load is unsqueezed. Next the loaded pallet with its plasticcovered base is moved by conveyor to a bagging station. The free edges of the plastic sheeting on the plastic covered base are folded upward and attached to the trays on the first tier of the produce load, and the mouth of a plastic bag is drawn downward over the top of the loaded pallet.

The bag is initially draped over an arm radiating from a bagger frame which keeps a supply of bags draped over a plurality of such radial arms at a convenient height. The arms extend from a rotatable hub so that bags can be moved into position above successive loaded pallets as they are needed. Following the bagging step the bagged pallet is moved to a turntable and sealed by rotation against springloaded overlapping strips of tape. After being moved, preferably automatically, to a gassing station, the sealed bag surrounding the produce is first evacuated and then filled with a suitably modified atmosphere to preserve the freshness of the produce. A preferred method for bag evacuation and subsequent gas filling in the Tectrol Atmosphere Injection System employs the insertion of nozzle means through the plastic bag. Gases inside the bag are first removed with vacuum means and then replaced with a spoilage-retardant modified gaseous atmosphere. The hole punctured in the bag by the inserted nozzle is sealed, preferably with a patch of tape. Optionally, the gassed pallet may be reoriented through 90° by a repositioning turntable and sent down an inclined portion of rollersurfaced table to a pallet exit area for removal, preferably by forklift.

SUMMARY OF THE INVENTION

An improved method and apparatus are disclosed for enclosing pallets of fresh produce in sealed bags, and furnishing the interiors of the sealed bags with a modified gaseous atmosphere for preserving such produce.

The first improvement relates to the incorporation of corrugated gripping surfaces to the interior surfaces of the opposed vertical walls (squeeze sidewalls) at the squeeze station. By aligning the ridges of the corrugated gripping surfaces to engage the known sturdy areas of the produce load or carton structure, a more effective suspension of the produce load, and a substantial reduction in damage to the load, cartons, or product results. Pneumatically operated "stops" at the squeeze station ensure precise alignment of the produce load with the corrugated gripping surfaces of the vertical walls when engaged.

Another improvement relates to a method and apparatus for depositing a plastic sheet lining onto the pallet base while the produce load is suspended above the pallet base. Previously, once the produce load was suspended, the entire wood pallet base was removed and replaced with a pallet having a plastic sheet lining already built into it. Here, the plastic sheet lining is deposited onto the pallet base while the produce load is suspended above it, thereby eliminating the need to remove and replace the pallet.

Typically, a bulk roll of plastic sheet lining is located adjacent to the in-line squeeze station. Once the produce load is suspended above the pallet base, the downwardly movable floorplate, and the pallet base resting thereon, descends. The pallet drops into a centering device which aligns the pallet into a position substantially equidistant from the squeeze sidewalls. At that time, a pair of gripping members grasp the leading edge of plastic sheet lining from the bulk roll and guide the plastic sheet lining over the pallet deck surface resting below the suspended produce load. The floorplate is raised to its former level to bear the weight of the loaded pallet. The pallet is unsqueezed and the plastic sheet lining is then severed from the supply. The loaded pallet then continues along the conveyor to the bagging station.

BRIEF DESCRIPTION OF THE DRAWINGS

The various features and advantages of the present invention will become apparent in light of the following detailed description taken together with the accompanying drawings, in which:

FIG. 8 is a top view of the produce load positioned between the two squeeze sidewalls.

FIG. 9 illustrates one of the typically 96 trays which contain the produce making up the produce load.

FIGS. 12, 13, and 14 illustrate a top, side, and rear view, respectively of the apparatus affecting the movement of the squeeze sidewalls.

FIGS. 20 and 21 illustrate the components and operation of the gripping members used to deposit the plastic sheet lining onto the pallet.

FIG. 22 illustrates the plastic sheet lining deposited onto a pallet.

DESCRIPTION OF THE PREFERRED EMBODIMENTS

The method and apparatus of the present invention will be described in terms of pallets loaded with strawberries, although only minor modifications in the sizing of the apparatus is necessary for application to other types of produce. A plurality of strawberry packages are initially stacked onto the upper surface of a pallet constructed of wood and comprising five slats on three runners. A fully loaded pallet contains 16 tiers of 6 trays in each tier and has an overall height of about 88 inches. Each tray contains 12 one-pint baskets of strawberries, so that a fully loaded pallet has 96 dozen pint baskets of strawberries. A strawberry pallet is generally 39 inches by 39 inches, whereas all other produce pallets may be 40 inches by 48 inches, or other dimensions. The strawberries are cooled to around 33° F., which is about 4° above the freezing point of the strawberries depending on their sugar content. The gassing operation is only done on produce which has been cooled to its respective optimum storage temperature.

Figure 1:
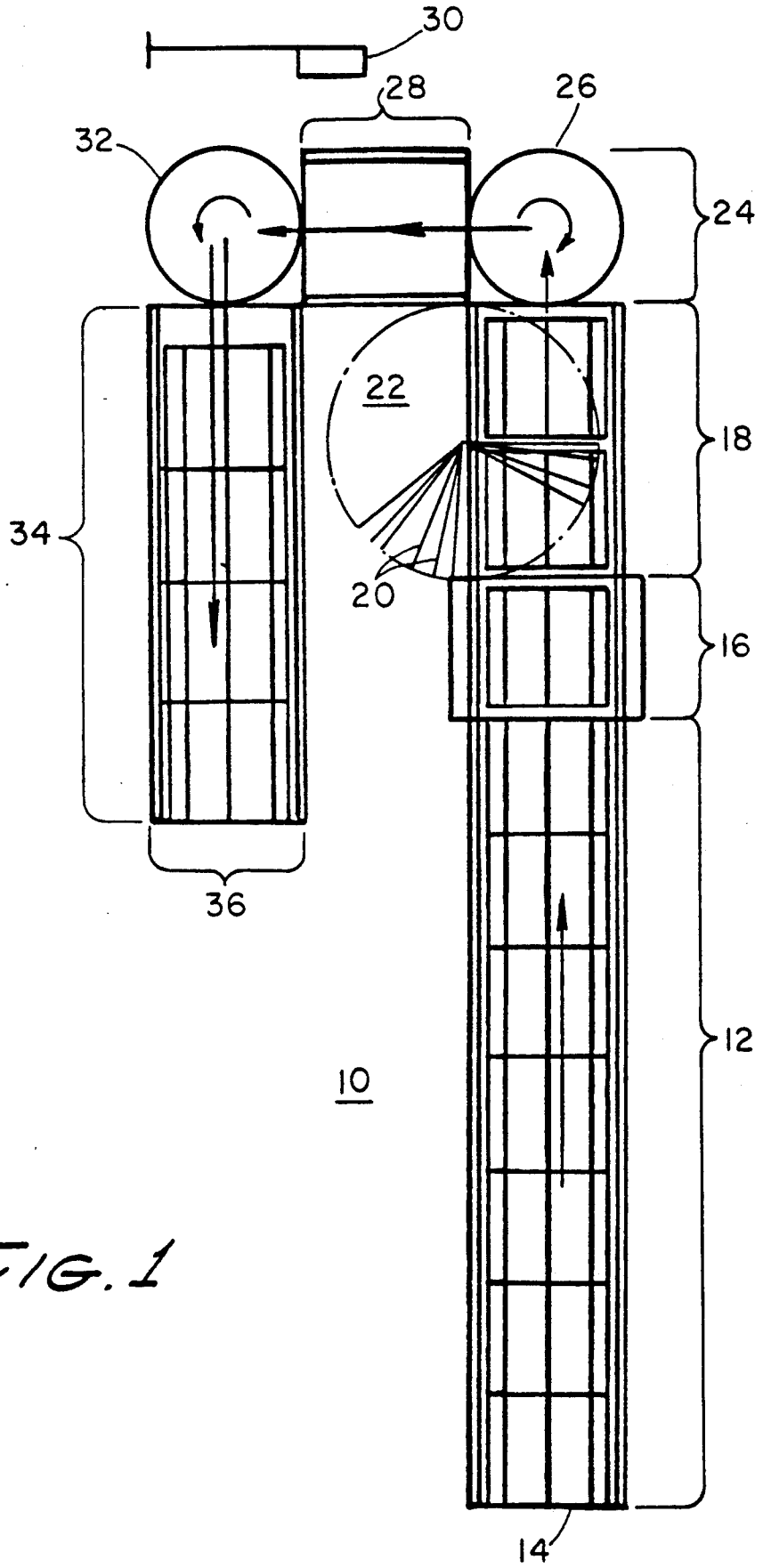
FIG. 1 is a schematic plan view of the layout of the squeeze station, pallet bagging, and sealing system.

FIG. 1 is a schematic plan view of the layout of the bagging apparatus 10 of the invention. An infeed portion 12 of apparatus 10 comprises a conveyor line using metal rollers which are actuated by a belt drive. Multiple pallets are brought by forklift and unloaded at infeed 14 of the conveyor line. When the first loaded pallet reaches a pallet squeeze station 16 the drive mechanism for the conveyor line is automatically shut off. Pallet squeeze station 16 comprises a hydraulically actuated pair of opposed vertical walls above a pneumatically actuated floorplate. Hydraulically actuated vertical walls approach each other by a distance calculated to squeeze the pallet load a sufficient amount to support it against the force of gravity. The floorplate on which the loaded pallet normally rests is pneumatically moved downward to allow the deposition of a generally rectangular plastic lining sheet onto the pallet. The sheet is generally flat and its edge margins extend several inches beyond the edges of the pallet. The floorplate is then raised to its original position to support the pallet load, the pallet load is unsqueezed, and the loaded pallet is moved to pallet bagging station 18.

Pallet bagging station 18 comprises a work area which will accommodate two loaded pallets, above Which, at a convenient height, are rotatable arm-like extensions 20 which form part of a pallet bagger frame 22. A plurality of plastic bags are folded or draped over extensions 20 so that the bag openings are at a height just greater than the top of a loaded pallet. Two workers are employed at pallet bagging station 18 in bagging the loaded pallets after the pallets have left pallet squeeze station 16. The edge margins of the plastic sheet inserted into each pallet base are stapled to the trays on the first tier of the pallet load in preparation for the bagging step. Bagging is done by pulling the opening of a bag lying draped on one of the extensions 20 over the top of the pallet load and downward to the base of the pallet. The free edges of the bag are made to overlap the stapled edges of the plastic sheet of the pallet base.

A bagged pallet prepared in this manner is then moved by conveyor rollers to a rotary tape sealing station 24, where the overlapping margins of the bag and the plastic sheet are sealed with tape. Rotary tape sealing station 24 comprises a turntable 26 on which the pallet is held against tape as turntable 26 rotates to seal the bag to the plastic sheet of the pallet base. After sealing is effected, the bagged pallet is transferred to gassing area 28 where a nozzle from an MA350 Tectrol Atmosphere Injection Unit 30 is inserted through a bag wall into the interior. First the interior gases in the sealed bag are evacuated through the nozzle forming a partial vacuum within the bag, and then a measured quantity of prescribed gas is injected. The nozzle is then withdrawn and the opening in the bag is closed with a patch of tape. In a turntable equipped system, the bagged, sealed, and gassed pallet may be transferred to repositioning turntable 32, rotated through 90°, and sent down an inclined table 34 with rollers to be stopped at off-feed area 36.

Figure 2:
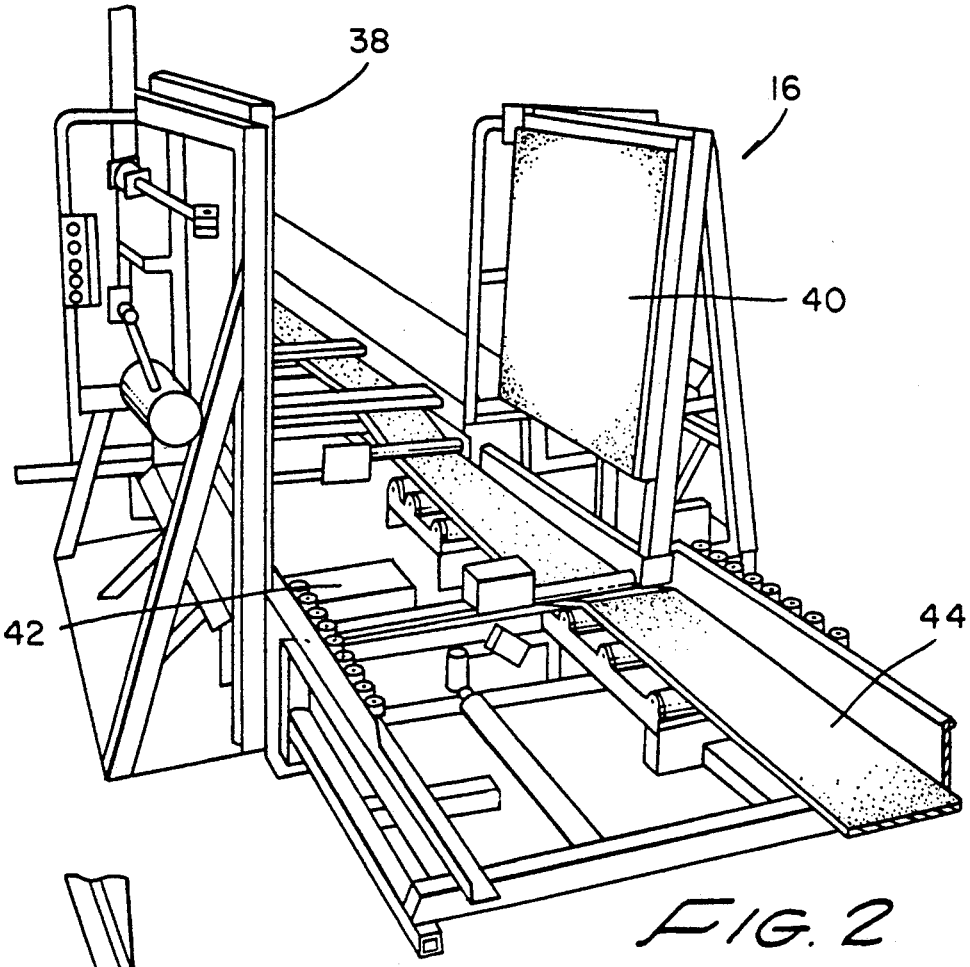
FIG. 2 is a perspective view of the apparatus of the squeeze station prior to the improvements.
Figure 3:
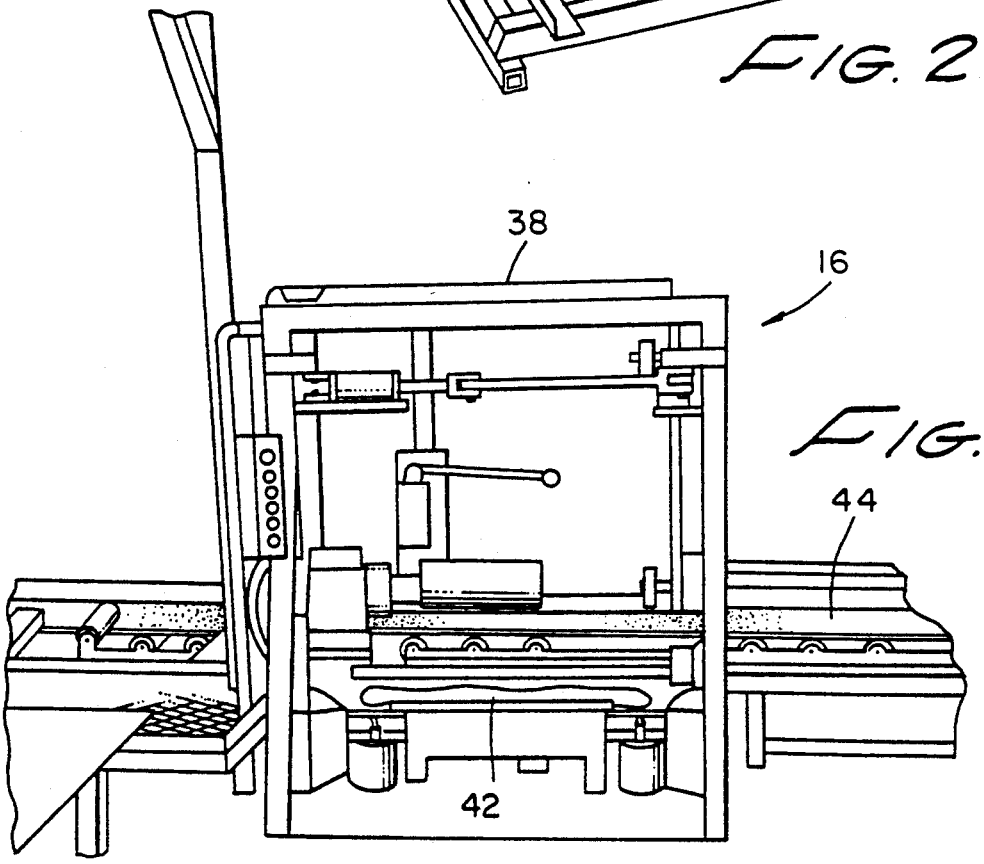
FIG. 3 is a side view of the apparatus of the squeeze station prior to the improvements.

Referring to FIG. 2, which is a perspective view of the apparatus of squeeze station 16 prior to the improvements, certain details of the apparatus may be seen.

Hydraulically actuated opposed vertical walls, called squeeze sidewalls, 38 and 40 flank a space above pneumatically actuated floorplate 42. When floorplate 42 is in its raised position the loaded pallet is brought into the space on conveyor belt 44. Sidewall 40 and sidewall 38 are hydraulically moved toward each other to squeeze the pallet load a sufficient amount to support it against the force of gravity. The entire squeeze operation is activated automatically.

Floorplate 42, on which the loaded pallet normally rests, is pneumatically moved downward to allow the deposition of plastic sheet lining onto the pallet base. Floorplate 42 is then raised to its original position to support the pallet load, the plastic sheet lining is automatically cut from the plastic lining roll stock, the pallet load is unsqueezed, and the loaded plastic-covered pallet unit is moved on conveyor belt 44 to pallet bagging station 18.

Figure 4:
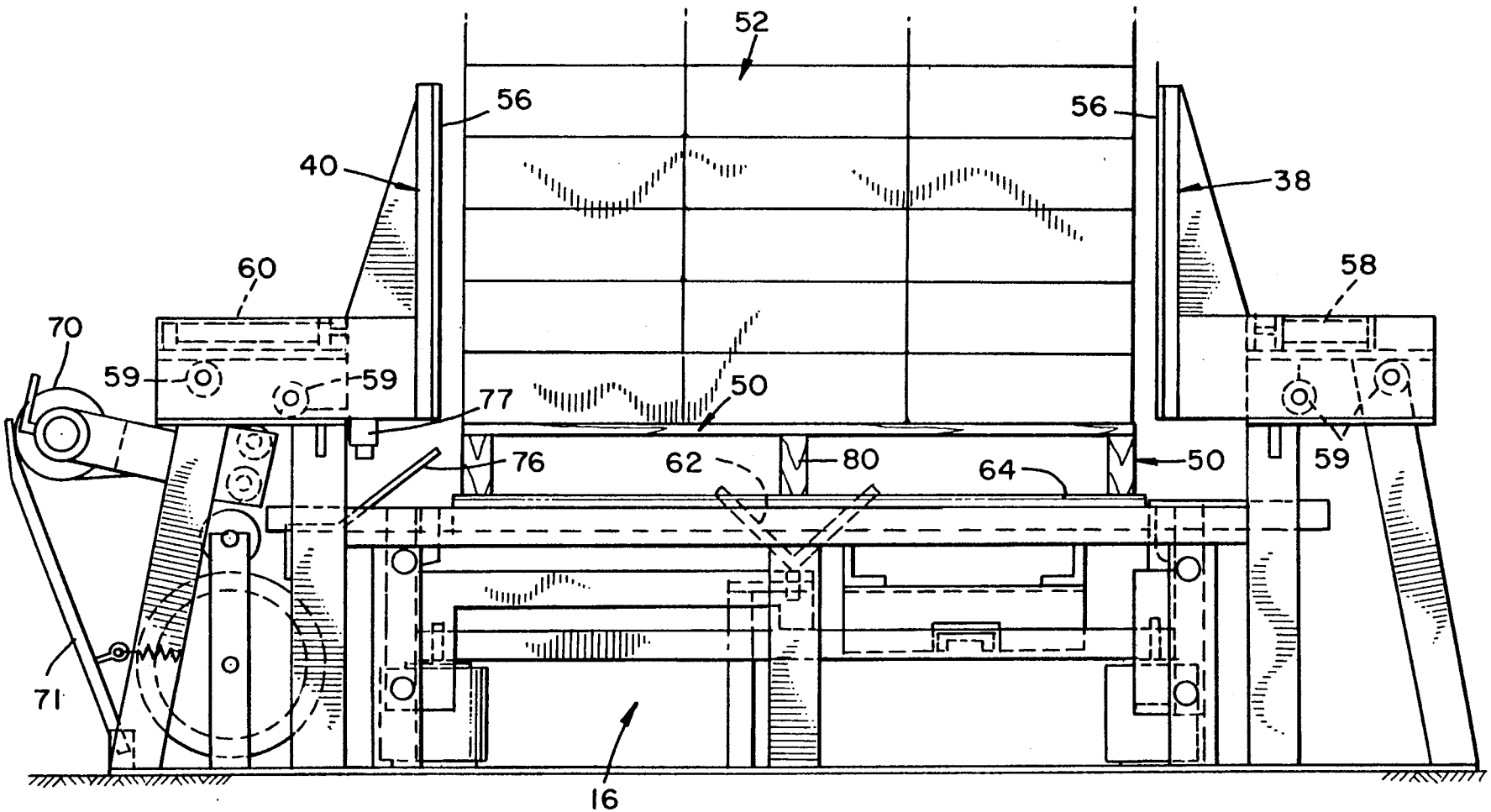
FIG. 4 is a front elevation view of the apparatus of the squeeze station.
Figure 5:
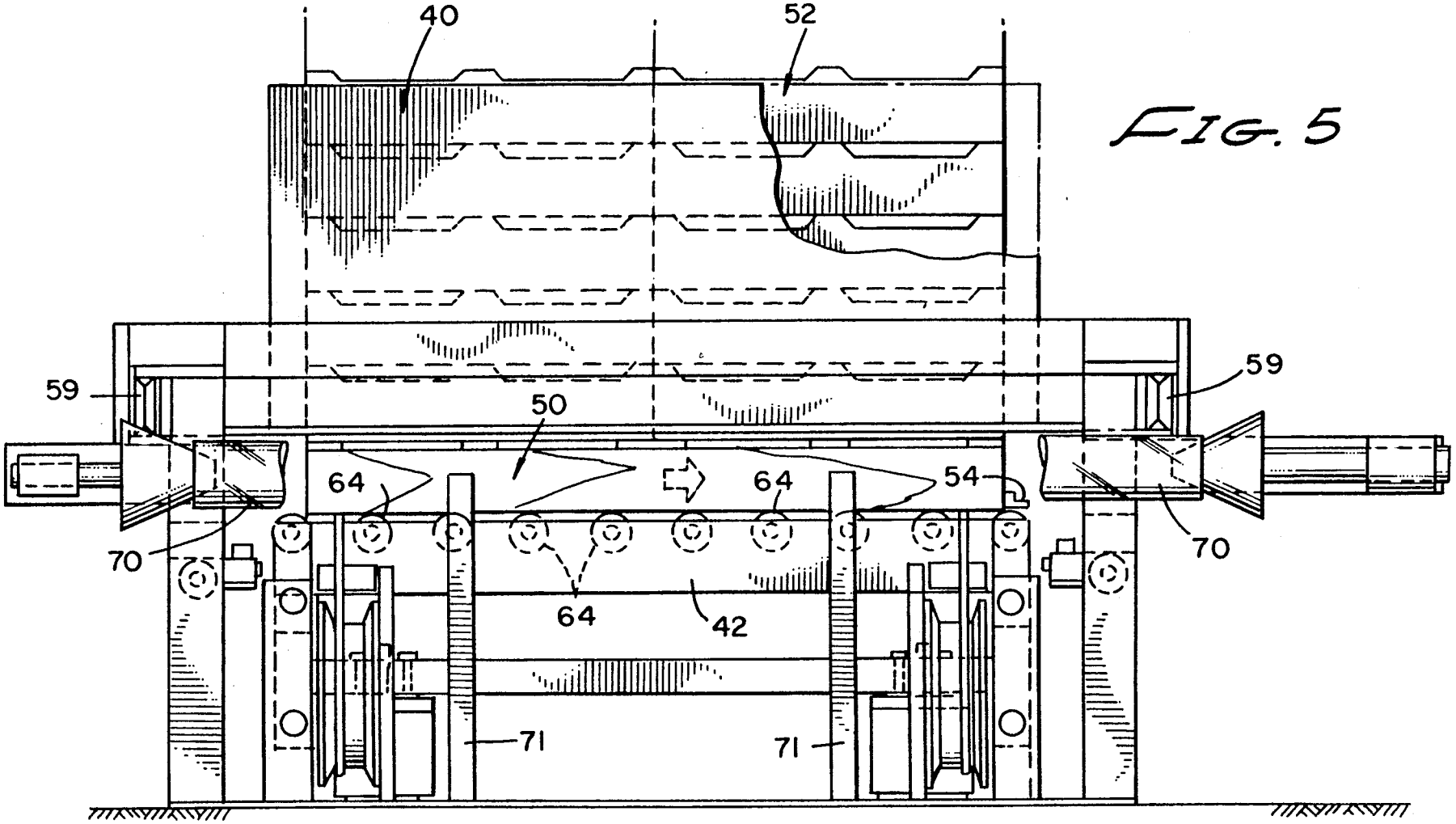
FIG. 5 is a side elevation view of the apparatus of the squeeze station.

FIGS. 4 AND 5 are a front and side elevation view, respectively, of the squeeze station 16. The pallet 50, supporting the produce load 52, arrives at the squeeze station 16 via the conveyor belt 44. A pneumatically operated "stop" 54 assists the conveyor belt 44 in orienting the pallet 50 and produce load 52 such that the ridges of the corrugated gripping surfaces of the sidewalls 56 are precisely aligned to engage the desired areas of the produce load 52.

Once the loaded pallet 50 is stopped in the squeeze station 16, both squeeze sidewalls 38, 40 automatically move inward to engage the vertical face of the produce load 52. Squeeze sidewalls 38, 40 move independently. One sidewall 38 moves initially and at a greater rate of speed, reaching a preset full extension, thus becoming a "false wall." The opposing sidewall 40 moving at a slower rate, engages the produce load 52 surface second, forcing the produce load 52 into the first sidewall 38 and applying pressure. Squeeze sidewalls 38, 40 are hydraulically powered 58, 60 and adjusted to apply pressures on each side of the produce load 52. A uniform pressure of approximately 12.85 pounds per square inch is applied simultaneously at an axis perpendicular to the produce load 52 surface. Once the squeeze sidewalls 38, 40 have reached the proper force on the produce load 52, the floorplate 42 support pneumatically moves downward. The produce load 52 is independently supported between those squeeze sidewalls 38, 40 with the pallet 50 resting on the conveyorized, lowered floorplate 42.

When the floorplate 42 lowers, the pallet 50 drops onto a centering device 62. The pallet 50 is mechanically centered by two V shaped fingers 62 Which extend through the rollers 64 of the floorplate 42. These V-shaped fingers 62 orient the center pallet runner such that the whole pallet 50 is positioned substantially equidistant from the vertical planes created by the squeeze sidewalls 38, 40.

Air actuated pneumatic gripping members 66 grasp each outside corner of the leading edge of the plastic sheet lining 68. The plastic sheet lining 68 is supplied from bulk roll stock 70 located adjacent to the squeeze station 16. Tension bars 71 control the dispensing of plastic sheet lining 68 from the bulk roll stock 70. The leading edge of the plastic sheet lining 68 is fed through a guide system to the gripping members 66.

Feeding off the bulk roll stock 70, the plastic sheet lining 68 is pulled through the pincher clamp assembly 74 over a series of guide fingers 76 and across the surface of the pallet 50 which is resting on the lowered floorplate 42 under the suspended produce load 52.

When the plastic sheet lining 68 and gripping members 66 have reached full extension beyond the opposite side of the pallet 50, the pincher clamp 74 is automatically closed. The closed pincher clamp 74 holds the plastic sheet lining 68 taut over the entire extended plastic sheet lining 68.

The plastic sheet lining 68 is held firmly by the end pincher clamp 74 adjacent to a first end of the pallet 50 and the gripping members 66 having traveled to the opposite end of the pallet 50. The floorplate 42 is then elevated such that the pallet 52 engages the extended plastic sheet lining 68, and then the produce load 52.

The squeeze sidewalls 38, 40 automatically release the produce load 52 so that the load weight is placed on the extended plastic sheet lining 68 and the pallet 50. A margin of plastic sheet lining 68 which overhangs the produce load 52 and pallet 50 dimension is still held taut by the pincher clamp 74 and gripping members 66. A cutting edge 78 then moves across the extended plastic sheet lining 68, slicing the taut portion extending between the pallet 50 and pincher clamp 74. The cutting edge 78 is pneumatically operated and severs the plastic sheet lining 68 immediately adjacent to the pincher clamp assembly 74. The plastic sheet lining 68, deposited between the produce load 52 and the pallet 50, is thereby cut away from the bulk roll stock 70. After the plastic sheet lining 68 has been cut, the gripping members 66 automatically release the leading edge of the plastic sheet lining 68 and return to their start position. The gripping members 66 then grasp onto the new leading edge of the bulk roll stock 7? released from the pincher clamp assembly 74 to prepare for deposition of the plastic sheet lining 68 onto a subsequent pallet 50. The stop 54 releases and the pallet 50 and produce load 52 are transported out of squeezing station 16 on the conveyor belt 44.

Figure 6:
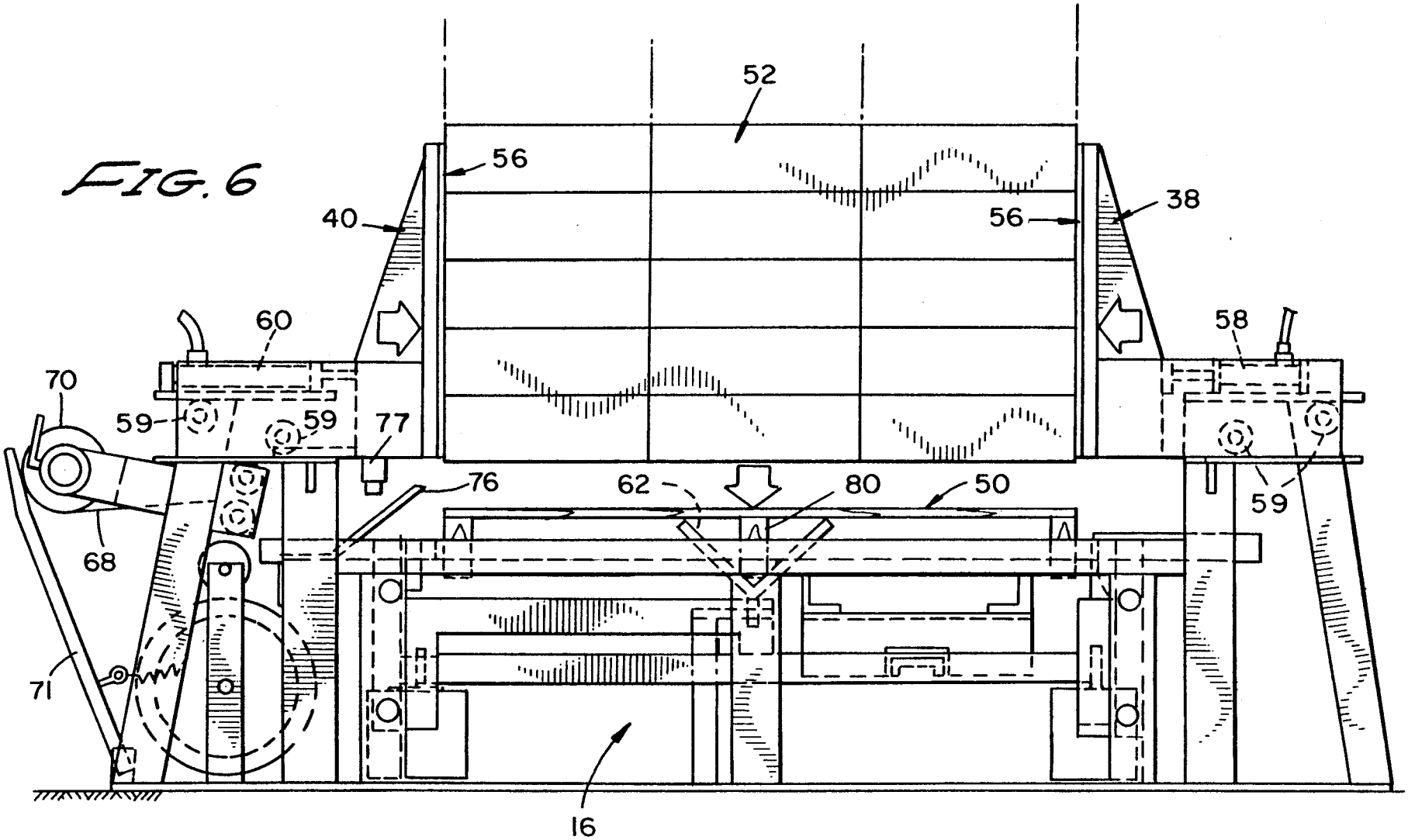
FIG. 6 is a front elevation view of the apparatus of the squeeze station with the load suspended and the pallet lowered.
Figure 7:
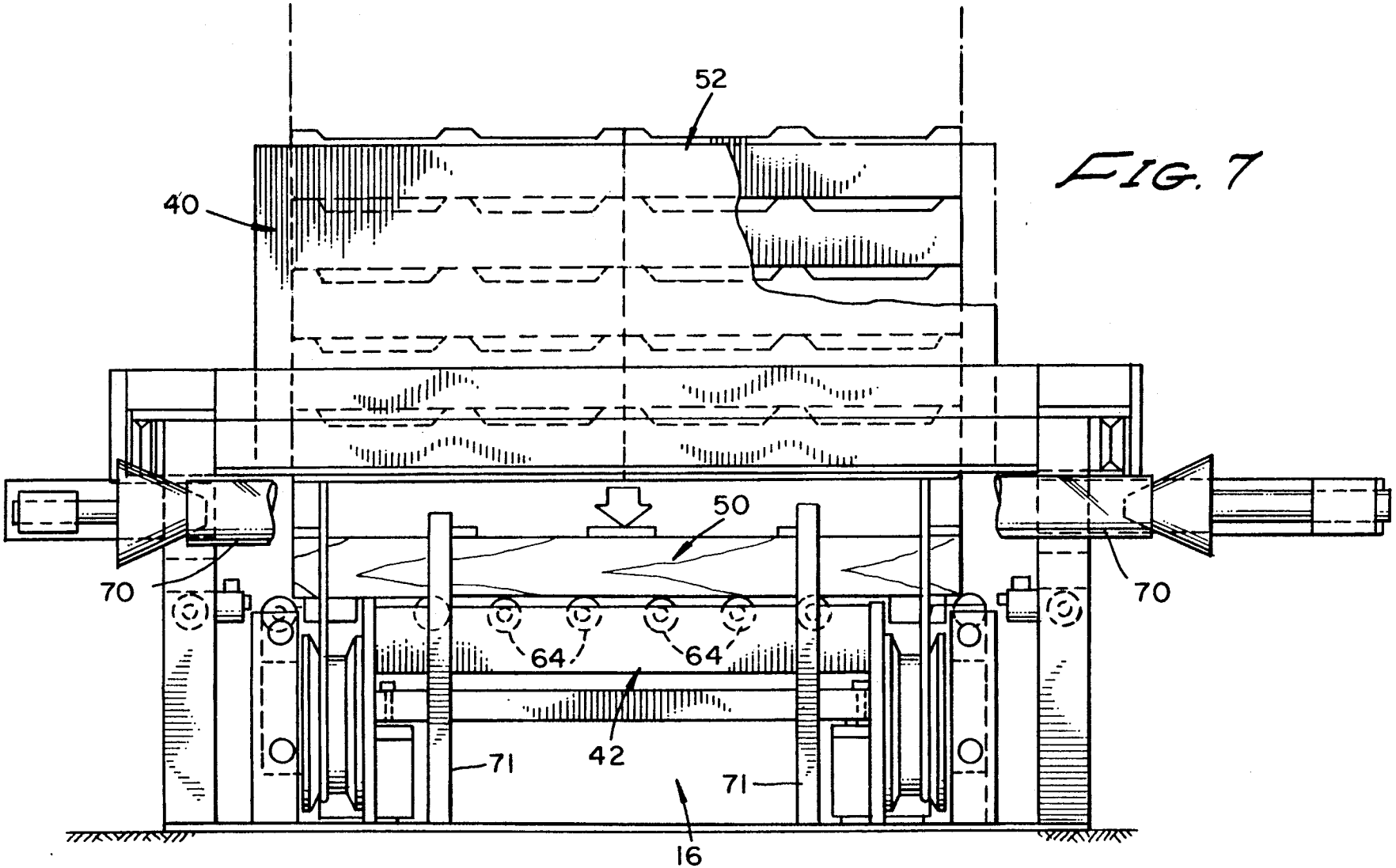
FIG. 7 is a side elevation view of the apparatus of the squeeze station with the load suspended and the pallet lowered.

FIGS. 6 AND 7 are a front and side elevation view, respectively, of the squeeze station 16 with the load 52 suspended and the pallet 50 in the lowered position. Referring to FIG. 6, when the pallet 50 is lowered, the center runner 80 engages the V-shaped fingers of the centering device 62.

FIG. 8 is a top view of the squeeze sidewalls 38, 40 engaging the produce load 52. The six trays 53 which represent the top layer of the produce load 52 are shown. The sturdy points of the load 41 are indicated. It is at these sturdy points 41 that the ridges of the corrugated surface 56 of the squeeze sidewalls 38, 40 engage the produce load 52. The corrugated gripping surfaces 39 are shown on the inner faces of the squeeze sidewalls 38, 40.

FIG. 9 shows a single tray 53 and the location of the sturdy points 41.

Figure 10:
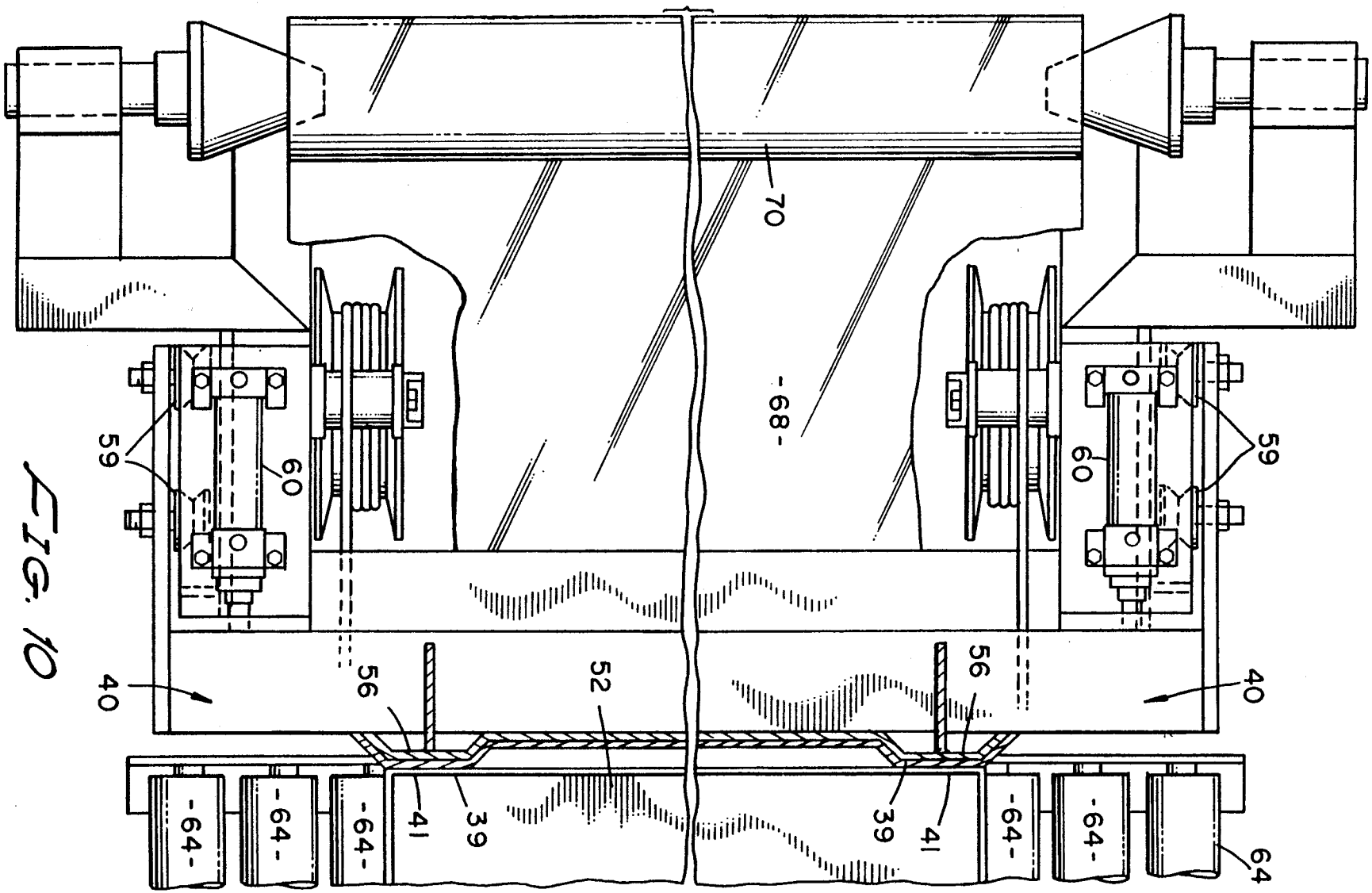
FIG. 10 is a top view of the plastic sheet lining, deposition apparatus, and one squeeze sidewall.

FIG. 10 is a top view of a squeeze sidewall 40 engaging the produce load 52. The ridges 56 of the corrugated gripping surfaces 39 engage the produce load 52 at the sturdy points of the load 41. Also shown are conveyor rollers 64 Which facilitate movement of the pallet 50 and produce load 40 into and out of the squeeze station 16.

The hydraulic cylinders 60 and rollers 59 cause movement of the squeeze sidewall board 40 to engage the produce load 52 for suspension of the produce load 52 above the pallet 50 for the deposition of the plastic sheet lining 68. After the plastic sheet lining 68 is in place on the pallet 50 the hydraulic cylinders 60 and rollers 59 cause the squeeze sidewall) 40 to disengage from the produce load 52.

Figure 11:
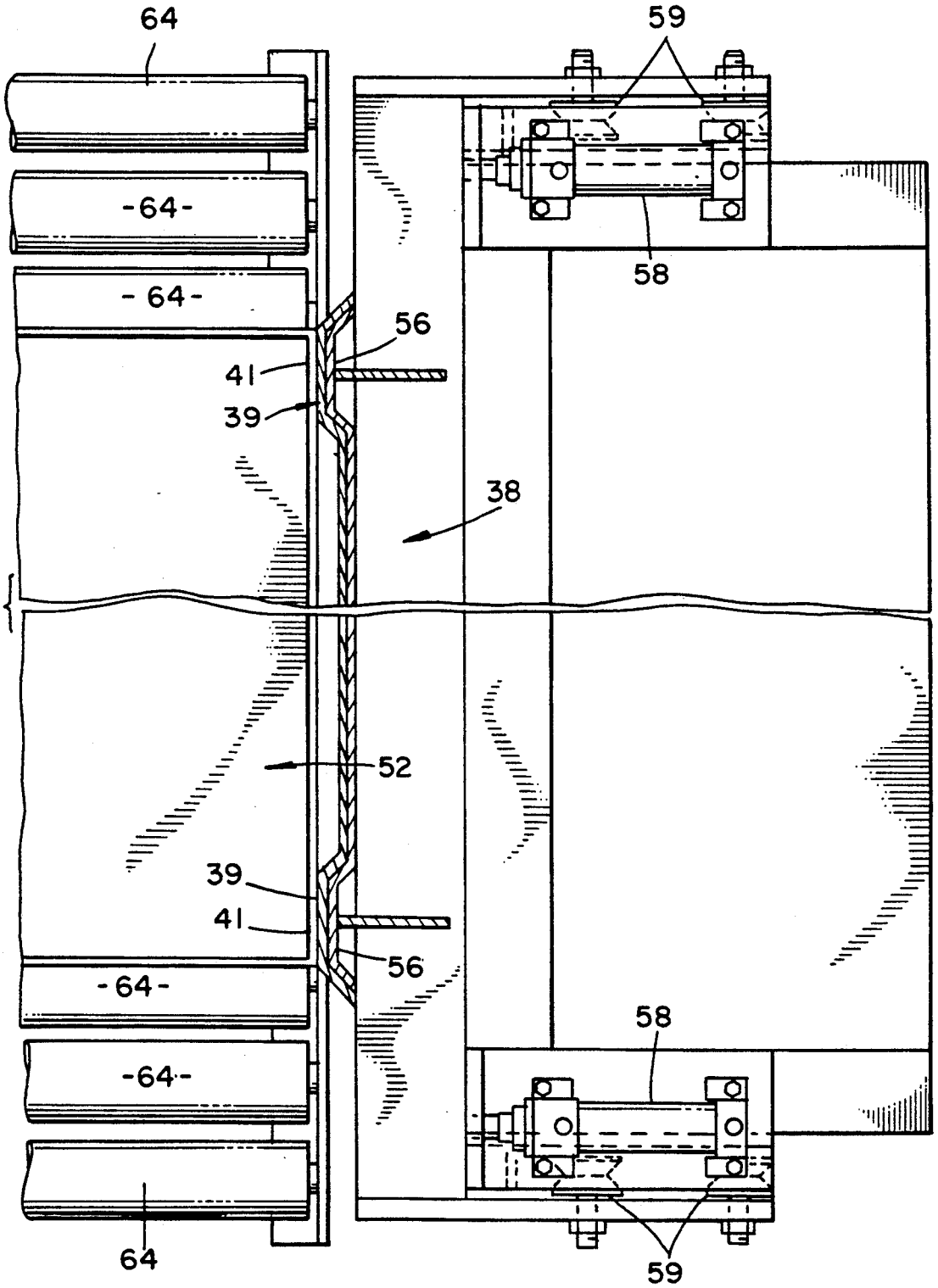
FIG. 11 is a top view illustrating a second squeeze sidewall.

FIG. 11 is a top view of the opposite squeeze sidewall 38 showing the hydraulic cylinders 58 and rollers 59 which cause the squeeze sidewall 38 to engage produce load 52 and to disengage the squeeze sidewall 38 from the produce load 52 after deposition of the plastic sheet lining 68.

FIGS. 12, 13 AND 14 show a side, top, and rear view, respectively, of the hydraulic cylinders 58, 60 and the rollers 59 which effect the movement of the squeeze sidewalls 38, 40. A grooved track system 61, together with the rollers 59 and hydraulic cylinders 58, 60, allow for precise movement and support of the squeeze sidewalls 38, 40 framework during horizontal movement.

Figure 15:
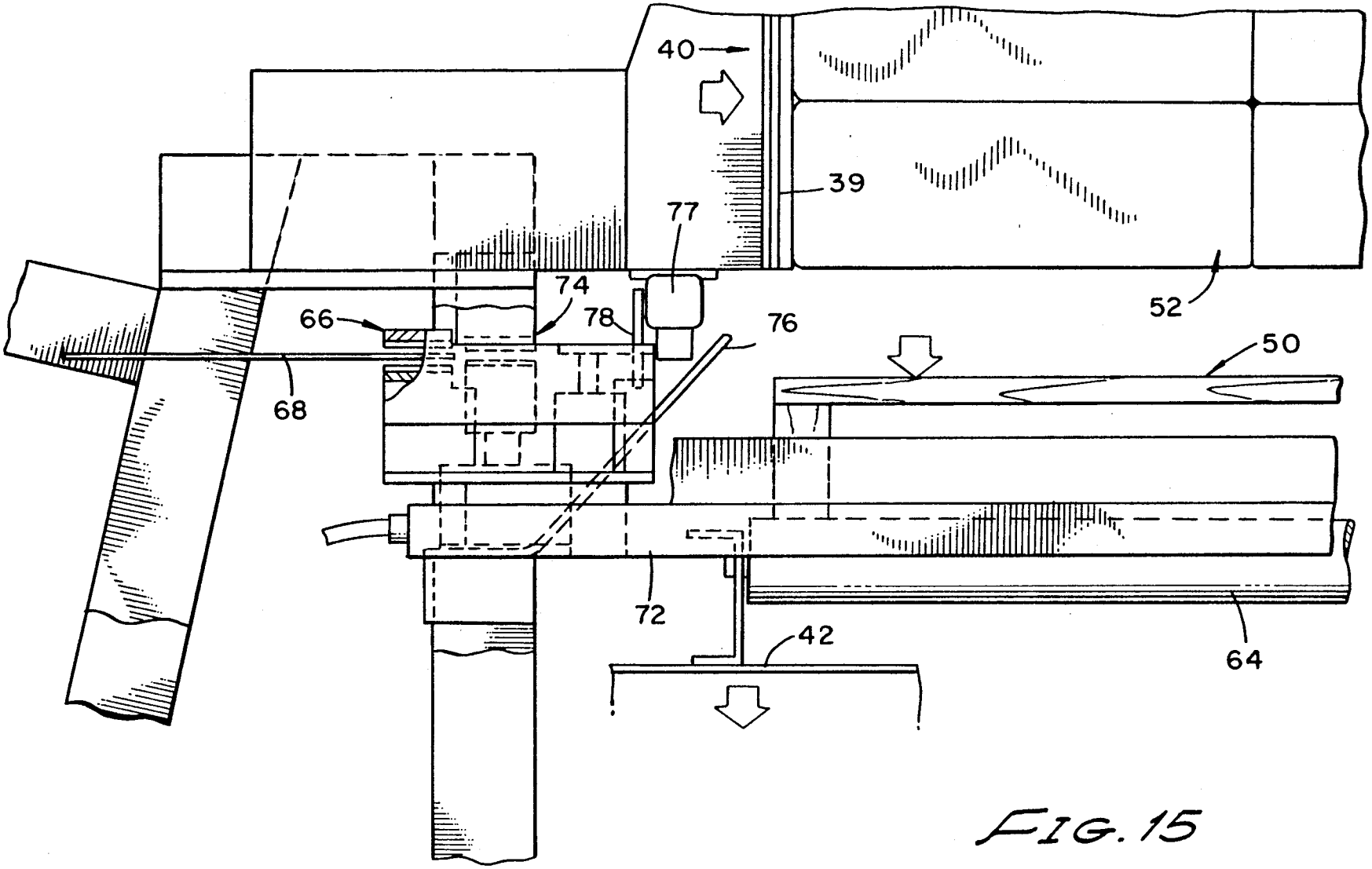
FIG. 15 is a front elevation view of the apparatus affecting the deposition of the plastic sheet lining.
Figure 16A:
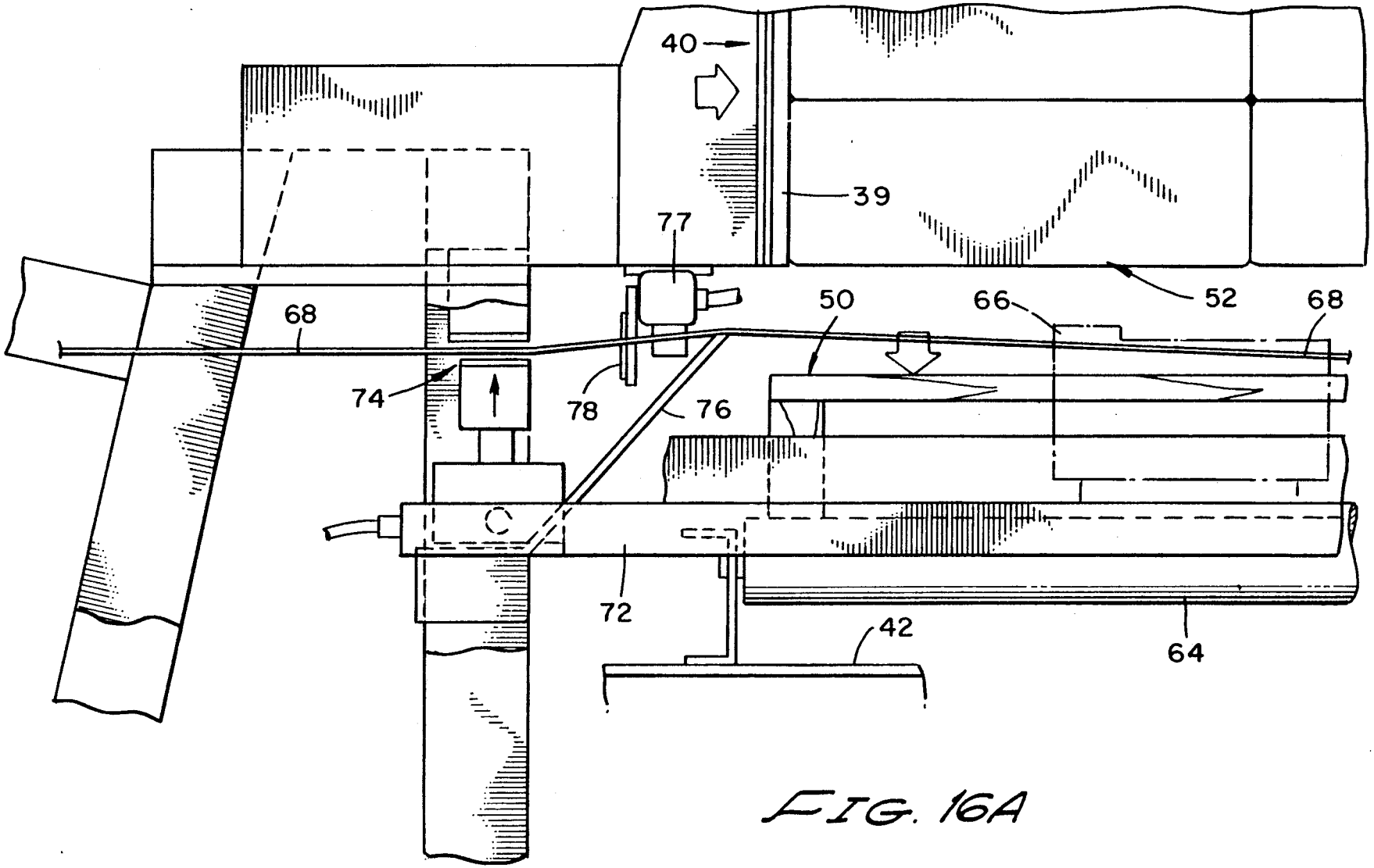
FIG. 16*a* and 16*b* are a front elevation view showing, in greater detail, the deposition of the plastic sheet lining.
Figure 16B:
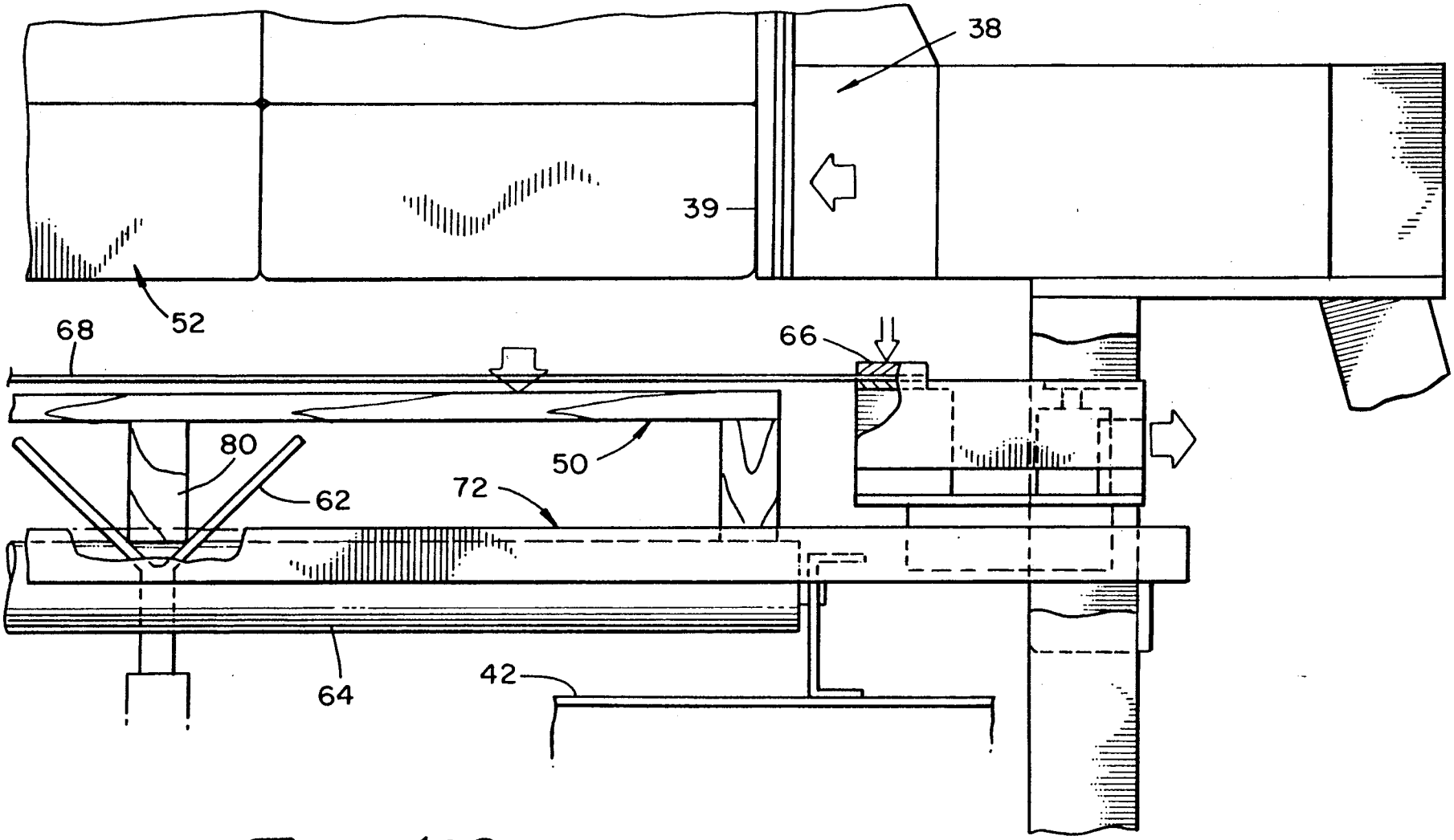
Figure 17:
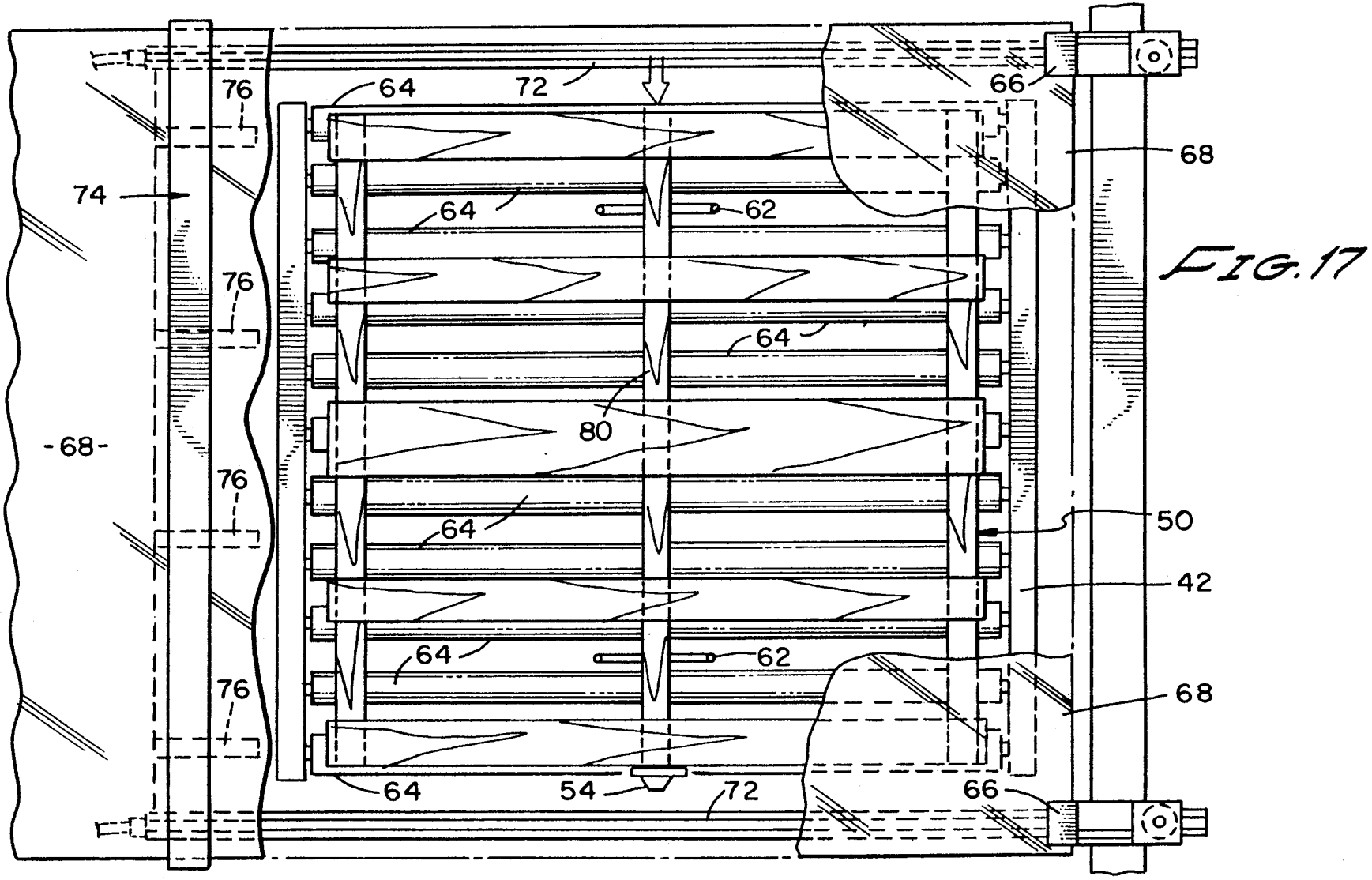
FIG. 17 is a top view of the plastic sheet lining fully extended across the pallet.

FIG. 15 is a side elevation view illustrating the deposition of the plastic sheet lining 68. With the produce load 52 suspended, and the pallet 50 lowered, the deposition of the plastic sheet lining 68 begins with a pair of gripping members 66 grasping the leading edge of the plastic sheet lining 68. Referring to FIG. 16, the plastic sheet lining 68 is fed through the pincher clamp assembly 74, over the guide fingers 76, across the pallet 50 to a position beyond the opposite end of the pallet 50. This is accomplished by the gripping members 66 traveling along the guide system 72 to the opposite end of the pallet 50. The plastic sheet lining 68 is held taut across the pallet 50 by the pair of gripping members 66 and the pincher clamp assembly 74. The pallet 50, having been centered substantially equidistant from the squeeze sidewalls 38, 40 by the centering device 62 is in position to be raised by the floorplate 42 to engage the produce load 52.

FIG. 77 is a top view, with the produce load 52 removed, of the plastic sheet assembly 68 deposited with the pallet 50. The pair of gripping members 66 are shown grasping the leading edge of the plastic sheet lining 68 having drawn the plastic sheet lining 68 across the pallet 50 to the opposite side of the pallet 50.

Figure 18:
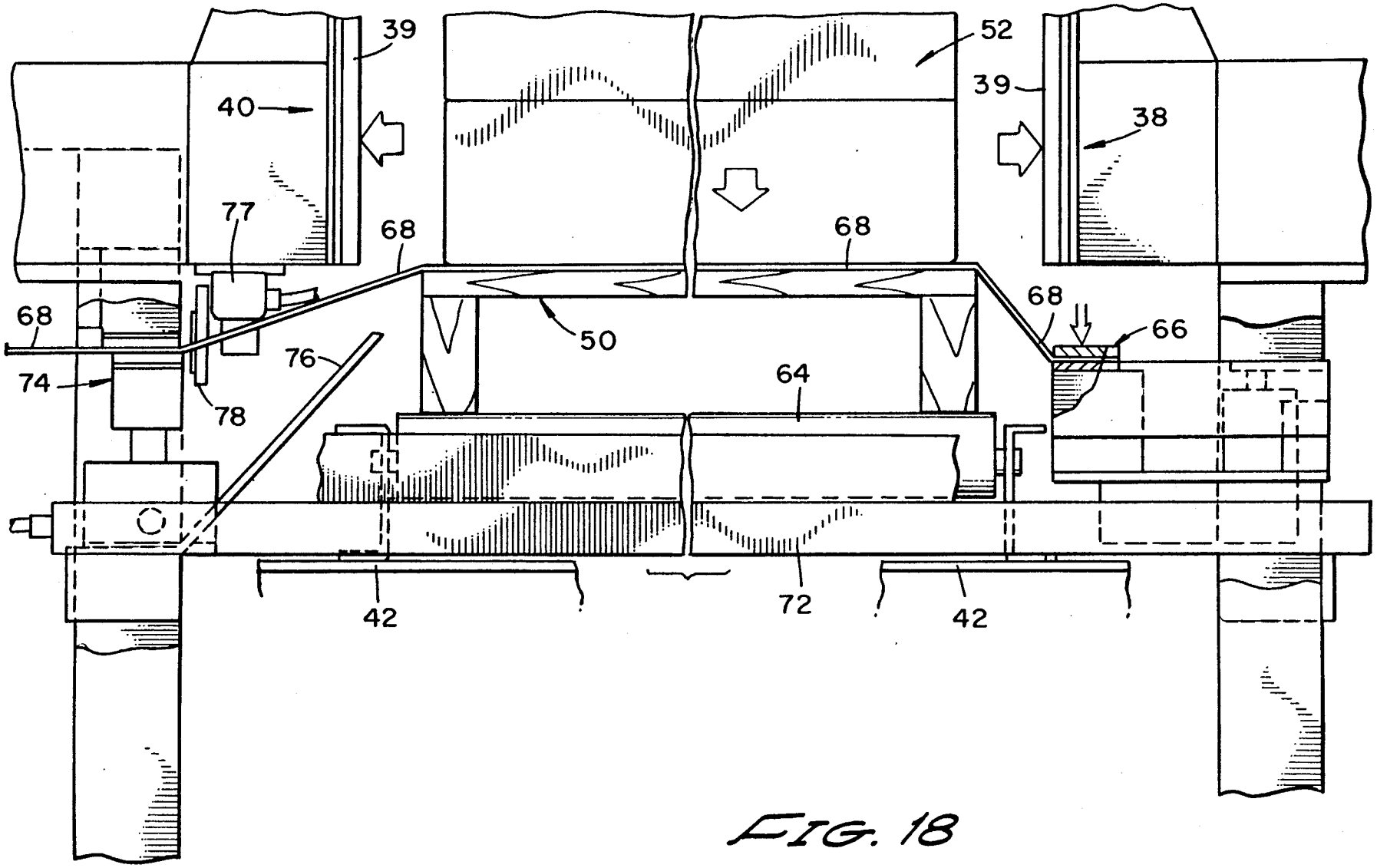
FIG. 18 is a front elevation view of the produce load released onto the pallet after the plastic sheet lining has been deposited onto the pallet.

FIG. 18 is a side elevation view showing the pallet 50, having been raised into position by the floorplate 42, engaging first the plastic sheeting lining 68 and then the produce load 52. The plastic sheet lining 68 is held taut at a first end by the pincher clamp assembly 74 and by the pair of gripping members 66 at the opposite end. The squeeze sidewalls 38, 40 disengage from the produce load 52 and retract.

Figure 19A:
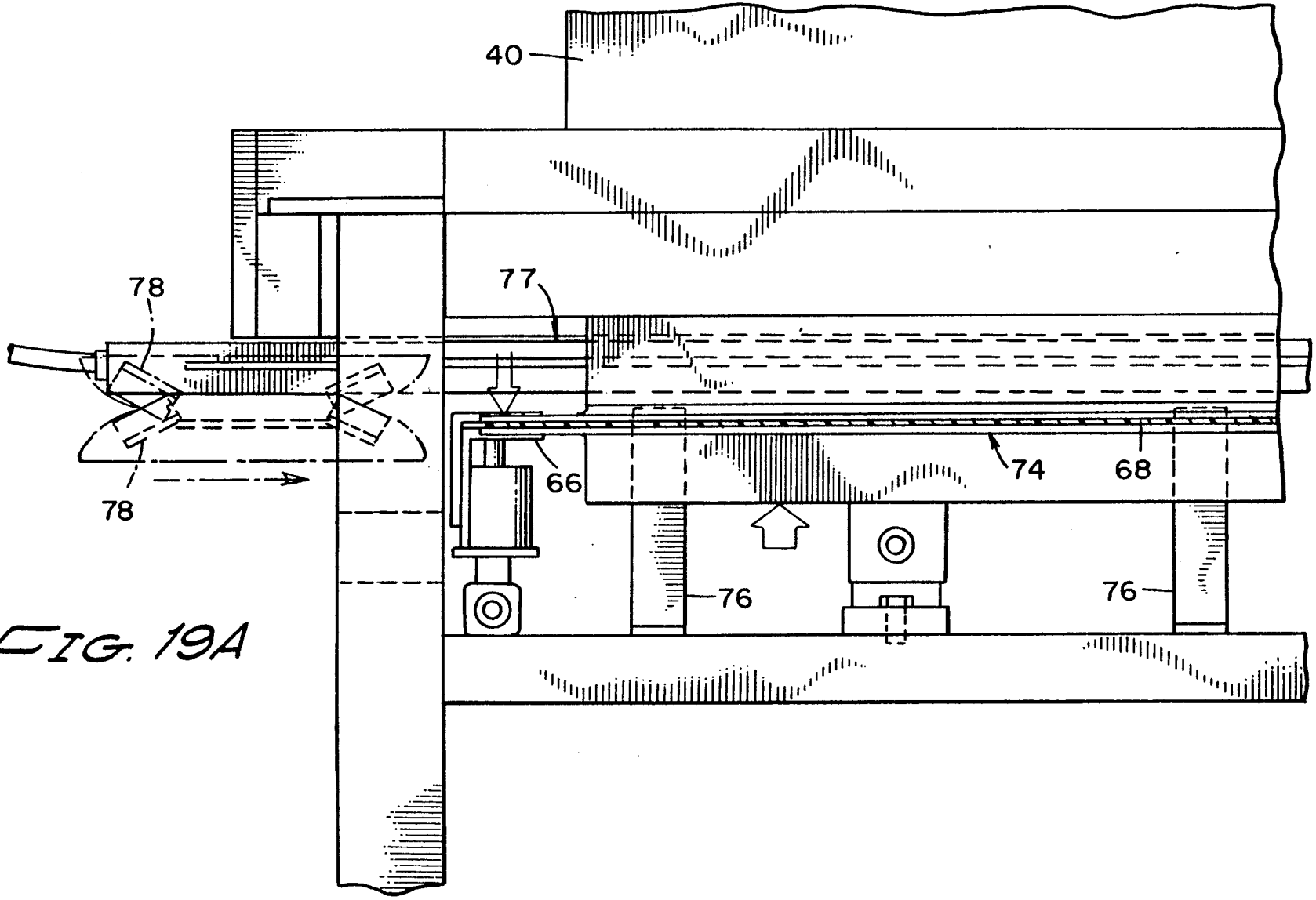
FIG. 19*a* and 19*b* illustrate the cutting apparatus used for severing the plastic sheet lining from the bulk roll stock, once the plastic sheet lining has been deposited onto the pallet.
Figure 19B:
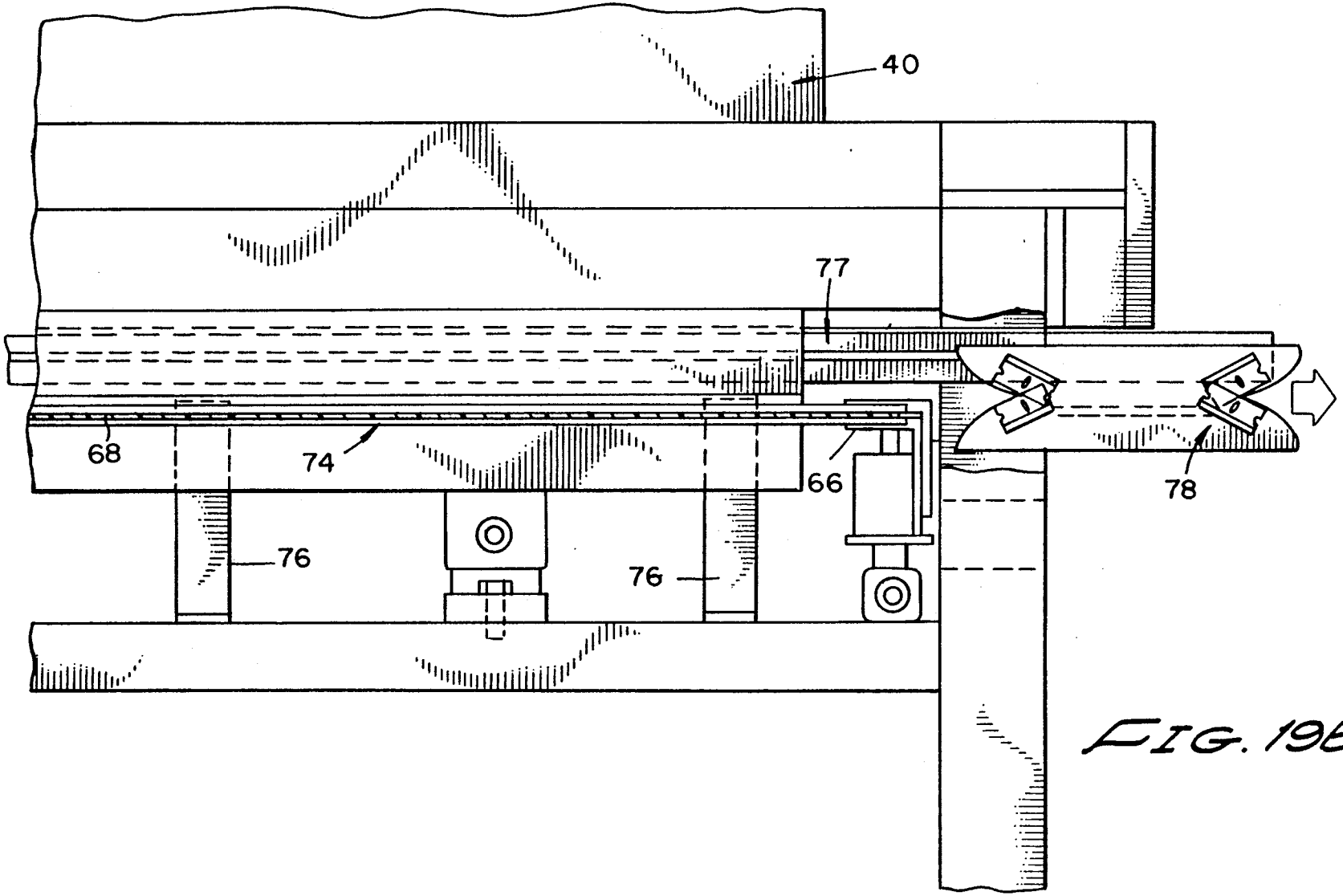
Figure 23A:
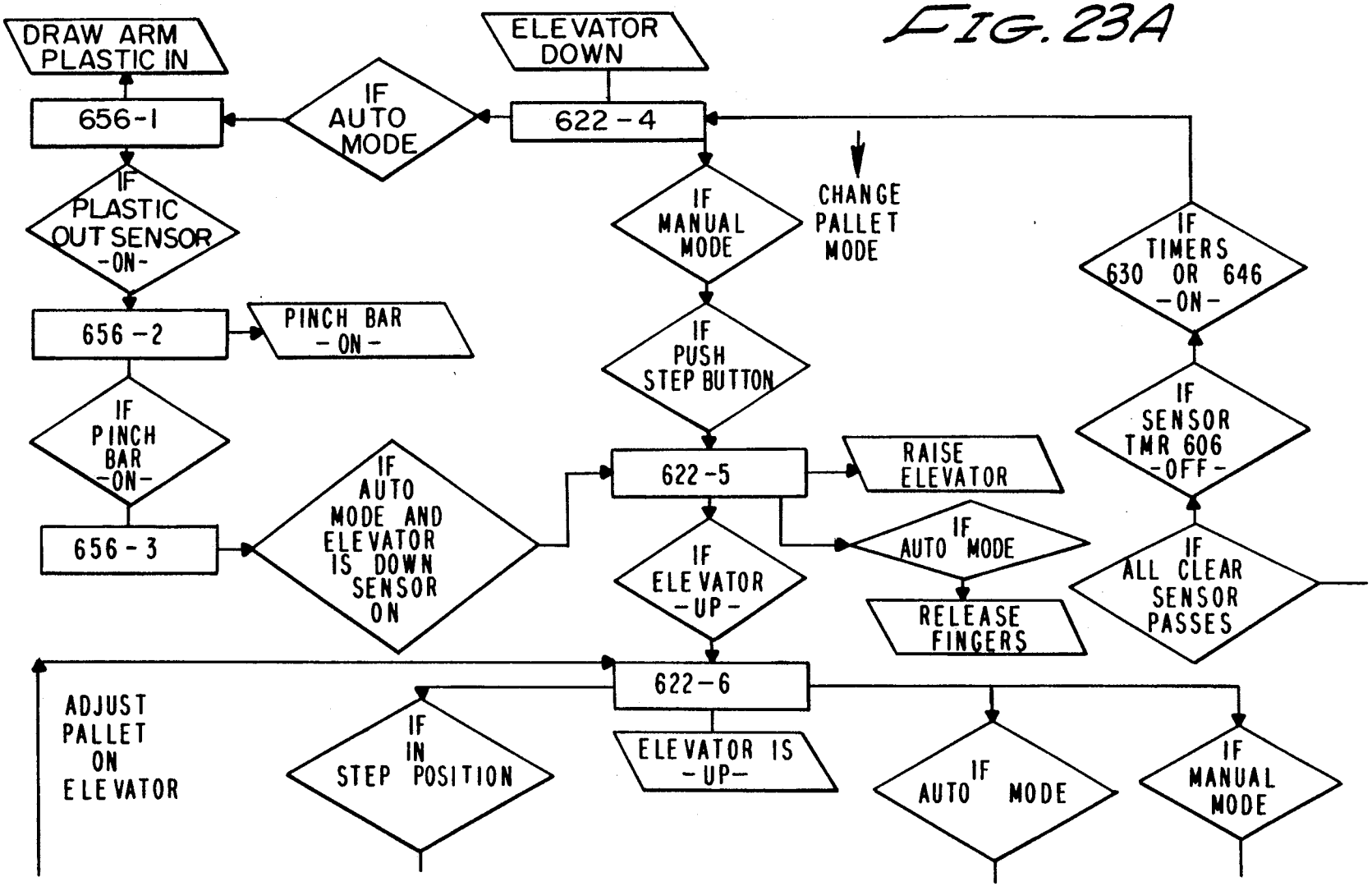
FIG. 23*a*–23*d* are a flow diagram of both the manual) and automatic operation of the squeeze station.
Figure 23B:
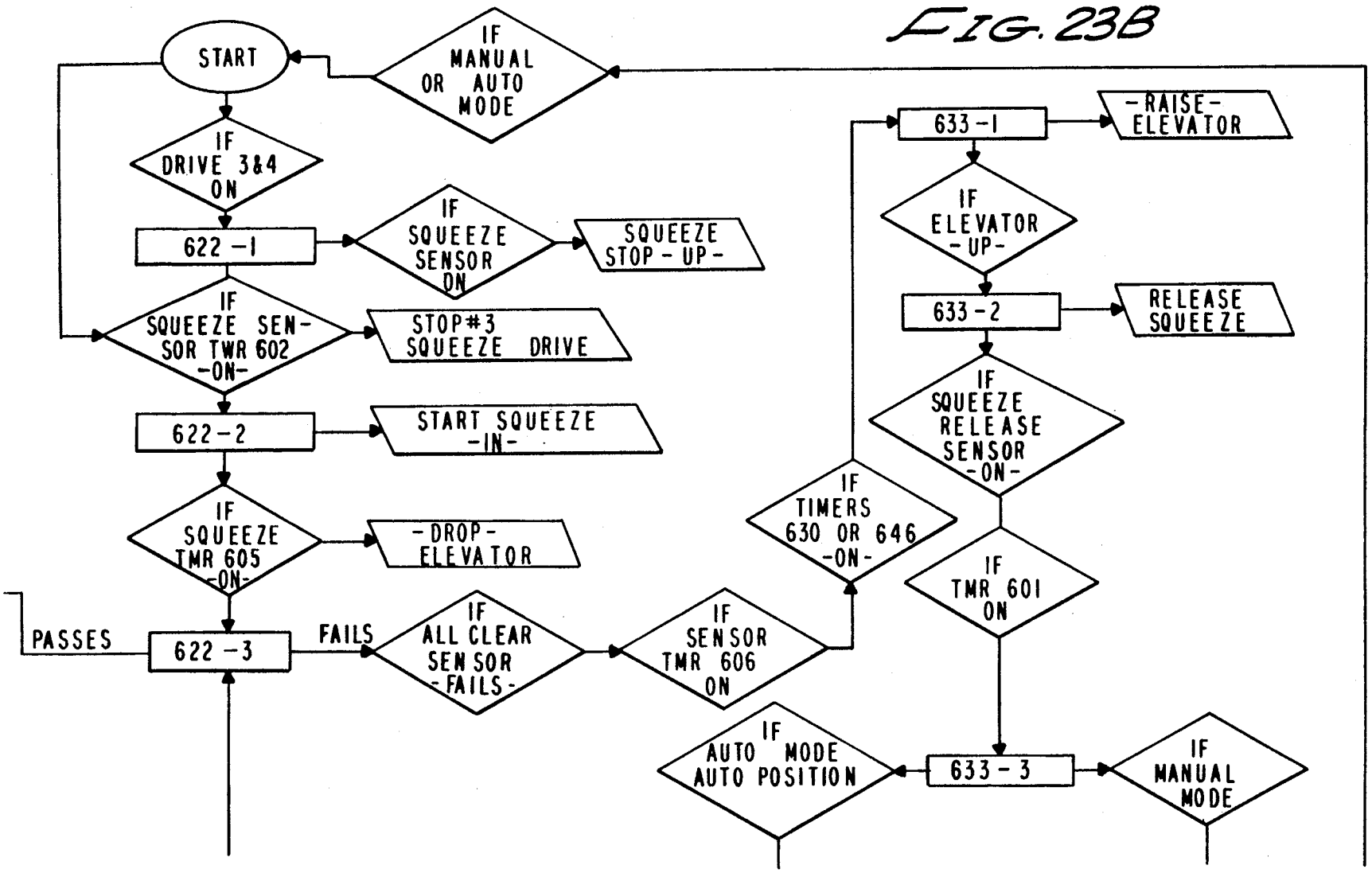
Figure 23C:
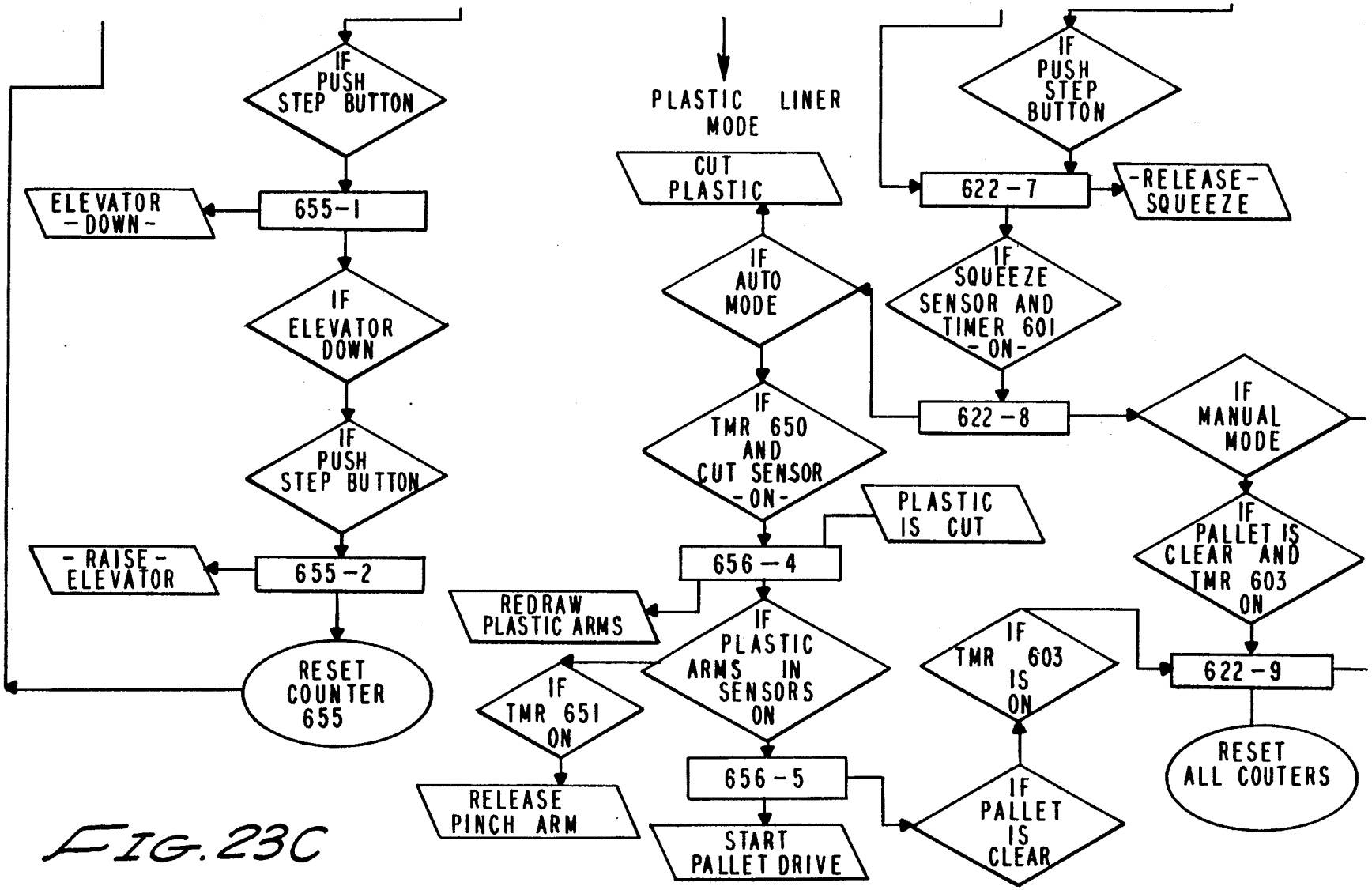
Figures 23D, 24:
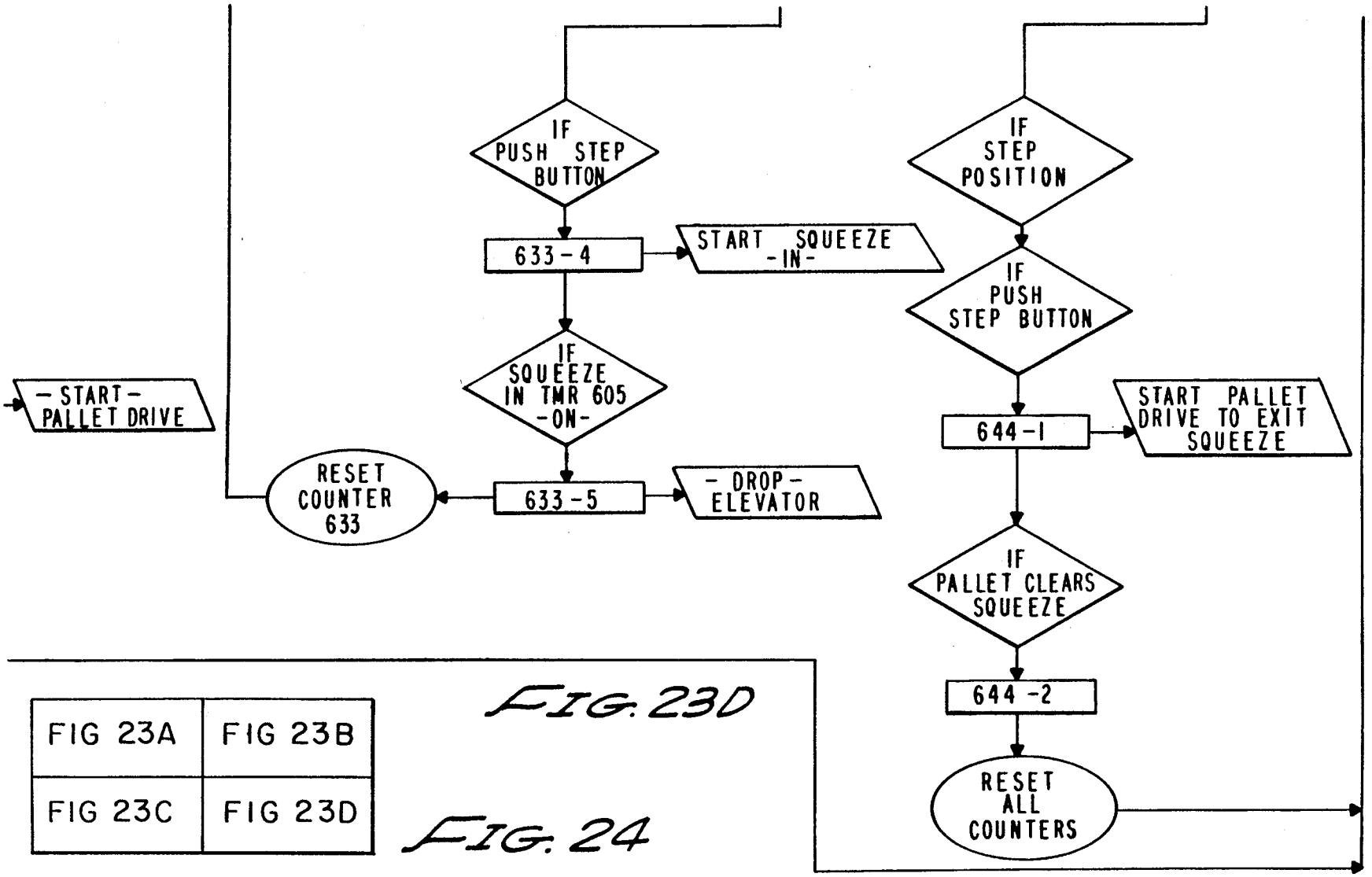
FIG. 24 illustrates the relationship between FIGS. 23*a*–23*d*.

FIG. 19 shows the plastic sheet lining 68 held by the pincher clamp assembly 74. The pincher clamp assembly 74 separates the plastic sheet lining 68 which has been deposited onto the pallet 50 from the bulk roll stock 70 (shown on FIG. 10). The cutting edge 78 travels along a pneumatic slide bar 77 to sever the plastic sheet lining 68 which has been deposited on the pallet 50 from the bulk roll stock 70. Typically, the cutting edge 78 can sever the plastic sheet lining 68 by traveling along the pneumatic slide bar 77 in both directions. Therefore, the cutting edge 78 can travel from one end of the slide bar 77 to the other, severing the plastic sheet lining 68 for one pallet 50 and travel back to its initial position severing the plastic sheet lining 68 for the next pallet 50.

FIGS. 20 and 21 detail the components in operation of the grippinq members 66. The gripping members 66 grasp the plastic sheet lining 68 when the pneumatic cylinder 67 causes the gripping members 66 to close.

FIG. 22 shows a pallet 50 with the plastic sheet lining 68 having been deposited onto the pallet 50. The produce load 52 is not shown.

FIG. 23 is a flow diagram that illustrates both the manual and automatic operations of the squeeze station 16.

The above-described embodiments are furnished as illustrative of the principles of the invention, and are not intended to define the only embodiments possible in accordance with our teaching. Rather, the invention is to be considered as encompassing not only the specific embodiments shown, but also any others falling within the scope of the following claims.

WHAT IS CLAIMED IS:

1. An apparatus comprising:

squeezer means for temporarily supporting a load over a pallet while a plastic lining is deposited onto said pallet;

liner depositing means for depositing said plastic lining onto said pallet;

bag dispensing means for dispensing plastic bags over said load;

positioner means for positioning a loaded said plastic-lined pallet beneath said bag dispensing means;

sealing means for sealing said plastic-lined pallet to one of said plastic bags with said load inside said bag;

atmosphere replacing means for replacing the atmosphere inside a said sealed bag; and means for moving a pallet from said squeezer and liner depositing means to said positioner means to said sealing means to said atmosphere replacing means.

2. The apparatus of claim 1 wherein said squeezer means comprises a downwardly movable floorplate and a pair of opposed vertical sidewalls, at least one of which is movable to control the distance therebetween.

3. The apparatus of claim 2 wherein each of said sidewalls has a facing surface, said facing surface comprising a corrugated gripping surface.

4. The apparatus of claim 3 comprising means for orienting said pallet together with said load on said pallet, such that said corrugated gripping surfaces engage said load at desired locations when said sidewalls are moved into contact with said load.

5. The apparatus of claim 4, wherein said opposed vertical sidewalls move to engage a said load positioned between said sidewalls such that said corrugated gripping surfaces of said sidewalls engage said load sufficiently to support said load when said downwardly movable floorplate lowers said pallet from a position supporting said load.

6. The apparatus of claim 2 wherein said sidewalls are operated hydraulically.

7. The apparatus of claim 5 wherein said sidewalls are operated hydraulically.

8. The apparatus of claim 6 wherein said squeezer means is operated by computer control means.

9. The apparatus of claim 8 wherein said squeezer means is operated by computer control means.

10. The apparatus of claim 2 wherein said squeezer means further comprises stopping means for aligning said loaded pallet in a desired position between said sidewalls.

11. The apparatus of claim 10 wherein said stopping means is operated pneumatically.

12. The apparatus of claim 11 wherein said stopping means is operated by computer control means.

13. The apparatus of claim 1 wherein said liner depositing means comprises:

a downwardly movable floorplate which lowers said pallet from a position supporting said load;

a plastic lining supply at a first end of said pallet;

gripping members to retrieve from said plastic lining supply said plastic lining to be deposited onto said pallet:

guiding means for guiding said gripping members with said plastic lining from said plastic lining supply at said first end of said pallet to a second end of said pallet;

clamping means located between said plastic lining supply and said first end of said pallet, for clamping said deposited plastic lining at said first end of said pallet; and, cutting means for cutting said deposited plastic lining from said plastic lining supply.

14. The apparatus of claim 13 wherein said gripping members are operated pneumatically.

15. The apparatus of claim 13 wherein said downwardly movable floorplate is operated pneumatically.

16. The apparatus of claim 13 wherein said guiding means is operated pneumatically.

17. The apparatus of claim 13 wherein said clamping means is operated pneumatically.

18. The apparatus of claim 1 wherein said cutting means is operated pneumatically.

19. The apparatus of claim 13 wherein said liner depositing means is operated by computer control means.

20. The apparatus of claim 13 further comprising centering means for centering said pallet into a desired position on said floorplate.

21. The apparatus of claim 20 wherein said centering means comprises at least one pair of V-shaped fingers vertically disposed such as to engage at least one runner of said pallet causing said pallet to be aligned in said desired position.

22. Apparatus for gastight sealing of a plastic bag, about foodstuff containers carried on a pallet, comprising;

first conveying means for conveying loaded pallets one at a time to a first location;

liner depositing means for depositing, at said first location, a plastic lining between said pallet and said load with said plastic lining having edges extending beyond edges of said pallet;

second conveying means for conveying a loaded plastic-lined pallet to a second location;

bagging station means at said second location for facilitating the enclosure of said loaded pallet with a plastic bag with its free edges overlapping said edges of said plastic lining;

third conveying means for conveying said loaded plastic-lined pallet base with said bag enclosing said pallet with free edges of said bag overlapping said plastic lining to a third location; and sealing station means at said third location for hermetically sealing said bag to said plastic lining of said pallet.

23. Apparatus as in claim 22 in which said liner depositing means comprise automatically controlled devices.

24. Apparatus as in claim 23 in which said automatically controlled devices include position sensing means for sensing the position of said loaded pallet and power switching means responsive to said position sensing means for controlling actuation of said liner depositing means.

25. Apparatus for gastight sealing of a plastic bag about foodstuff containers carried on a pallet, comprising;

first conveying means for conveying loaded pallets one at a time to a first location;

squeeze station means at said first location for holding the load of a pallet so that a plastic liner can be deposited onto said pallet, the load then being released onto said pallet having said plastic liner;

second conveying means for conveying said loaded plastic-lined pallet to a second location;

bagging station means at said second location including a bagger frame with horizontally rotatable arm-like extensions radiating horizontally from a central vertical member, said extensions being at a height so that plastic bags folded thereover hang down to a height above a top of a loaded pallet positioned beneath said bagger frame extensions;

third conveying means for conveying a loaded plastic-lined pallet base with a bag enclosing said pallet with free edges of said bag overlapping edges of said plastic sheet to a third location; and sealing station means for hermetically sealing said bag to said plastic sheet of said pallet.

26. Apparatus as in claim 25 in which said squeeze station means comprise automatically controlled devices.

27. Apparatus as in claim 26 in which said automatically controlled devices include position sensing means for sensing the position of said loaded pallet and power switching means responsive to said position sensing means for controlling actuation of said conveying means.

28. A method comprising the steps of:

temporarily supporting a load over a pallet while a plastic lining is deposited on said pallet;

depositing said plastic lining on said pallet;

placing said load onto said plastic-lined pallet;

positioning said loaded plastic-lined pallet beneath a bag dispensing means;

dispensing a plastic bag over said load;

sealing said plastic-lined pallet to said plastic bag with said load inside said plastic bag;

replacing an atmosphere inside said sealed plastic bag.

29. A method of claim 28 wherein temporarily supporting a load over a pallet comprises the steps of:

squeezing said load between a pair of opposed vertical sidewalls with sufficient force to suspend said load; and, lowering said pallet to expose a gap between said pallet and said load wherein said plastic lining may be deposited.

30. A method of claim 29 wherein said squeezing of said load further comprises the step of orienting said pallet together with said load on said pallet, such that said opposed vertical sidewalls engage said load at desired locations when said sidewalls are moved into contact with said load.

31. The method of claim 28 wherein depositing plastic lining on said pallet comprises the steps of:

lowering said pallet from its position supporting said load;

gripping a leading edge of said plastic lining from a plastic lining supply;

guiding said plastic lining from plastic lining supply at first end of said pallet across said pallet to a second end of said pallet;

clamping said plastic lining between said plastic lining supply and said first end of said pallet; and, cutting said deposited plastic lining from said plastic lining supply.

32. A method for gastight sealing of a plastic bag about food stuff containers carried on a pallet, comprising the steps of:

conveying loaded pallets one at a time to a first location;

depositing, at said first location, a plastic lining between said pallet and said load with said plastic lining having edges extending beyond edges of said pallet;

conveying said loaded plastic-lined pallet to a second location;

enclosing said loaded plastic-lined pallet with a plastic bag with its free edges overlapping said edges of said plastic lining;

conveying said loaded plastic-lined pallet with said bag enclosing said pallet with said free edges of said bag overlapping said plastic sheet to a third location; and, hermetically sealing said bag to said plastic lining of said pallet at said third location.

33. A method for depositing a plastic lining between a load on a pallet and said pallet, comprising the steps of:

temporarily supporting said load over said pallet;

lowering said pallet from its position supporting said load;

gripping a leading edge of said plastic lining from a plastic lining supply;

guiding said plastic lining from said plastic lining supply at a first end of said pallet across said pallet to a second end of said pallet;

clamping said plastic lining between said plastic lining supply and said first end of said pallet; and, cutting said deposited plastic lining from said plastic lining supply.

* * * * *